US008794198B2

(12) United States Patent
Cockerill

(10) Patent No.: US 8,794,198 B2
(45) Date of Patent: Aug. 5, 2014

(54) FREE PISTON ENGINE

(75) Inventor: Sam Cockerill, Yorkshire (GB)

(73) Assignee: Libertine FPE Ltd., Yorkshire (GB)

( * ) Notice: Subject to any disclaimer, the term of this patent is extended or adjusted under 35 U.S.C. 154(b) by 0 days.

(21) Appl. No.: 13/517,161

(22) PCT Filed: Dec. 17, 2010

(86) PCT No.: PCT/GB2010/052123
§ 371 (c)(1),
(2), (4) Date: Jun. 19, 2012

(87) PCT Pub. No.: WO2011/077119
PCT Pub. Date: Jun. 30, 2011

(65) Prior Publication Data

US 2012/0280513 A1 Nov. 8, 2012

(30) Foreign Application Priority Data

Dec. 24, 2009 (GB) ..... 0922539.2

(51) Int. Cl.

| | |
|---|---|
| ***F02B 71/00*** | (2006.01) |
| ***F02B 71/04*** | (2006.01) |
| ***F01B 11/00*** | (2006.01) |
| ***F02B 63/04*** | (2006.01) |
| ***F01L 9/04*** | (2006.01) |
| *F02B 75/00* | (2006.01) |

(52) U.S. Cl.
CPC ..... *F01B 11/001* (2013.01); *F02B 71/04* (2013.01); *F02B 75/002* (2013.01); *F02B 63/04* (2013.01); *F01L 9/04* (2013.01)
USPC ..... 123/46 E; 123/46 A

(58) Field of Classification Search
USPC ..... 123/46 A, 46 R, 46 E, 188.1, 188.4, 123/188.2, 188.5, 65 V, 65 EM, 65 P, 90.1, 123/90.11, 184.21, 184.24, 184.34, 184.42, 123/184.47; 290/1 A
See application file for complete search history.

(56) References Cited

U.S. PATENT DOCUMENTS 3,105,153 A * 9/1963 James, Jr. ..... 290/1 R
(Continued)

FOREIGN PATENT DOCUMENTS

DE 32 24 723 1/1984
DE 3224723 1/1984
(Continued)

OTHER PUBLICATIONS

International Preliminary Report on Patentability dated Jul. 5, 2012 for International Application No. PCT/GB2010/052123, filed Dec. 17, 2010.

(Continued)

*Primary Examiner* — Hung Q Nguyen
(74) *Attorney, Agent, or Firm* — Andrus Intellectual Property Law, LLP

(57) ABSTRACT

A free-piston engine has an engine cylinder and a single piston member. The single piston member has a double-ended piston that moves within the cylinder, and the piston member partitions the cylinder into two separate chambers, each of which are supplied with a compressible working fluid from one or more intake means. The piston moves over and past the intake means during each stroke such that the fluid is replenished within one chamber while the piston compresses the fluid held in the other chamber.

10 Claims, 23 Drawing Sheets

(56) References Cited

U.S. PATENT DOCUMENTS

| | | | | |
|---|---|---|---|---|
| 4,484,082 | A | 11/1984 | Bucknam | |
| 4,653,274 | A * | 3/1987 | David | 60/595 |
| 5,775,273 | A | 7/1998 | Beale | |
| 5,788,003 | A | 8/1998 | Spiers | |
| 6,199,519 | B1 * | 3/2001 | Van Blarigan | 123/46 R |
| 6,651,599 | B2 * | 11/2003 | Wechner | 123/46 R |
| 7,318,506 | B1 * | 1/2008 | Meic et al. | 290/1 A |

FOREIGN PATENT DOCUMENTS

| | | |
|---|---|---|
| DE | 20 2006 018 097 | 6/2006 |
| DE | 202006017097 | 4/2008 |

OTHER PUBLICATIONS

International Search Report for PCT/GB2010/052123 dated Sep. 13, 2011.

* cited by examiner

| Determination of compression ratio and response to compression ratio | | | | |
|---|---|---|---|---|
| Step | Part of cycle (Chamber 3) | Signal | Compression ratio control means | Response |
| 1 | Continuous over several cycles | Required power output of engine (Load)<br><br>Engine speed | Intake valve control means | Duration of intake valve open period<br><br>Air admission to chamber 3 & 4 (control signal) |
| 2 | | Required power output of engine (Load) | Coils | Set force so that kinetic energy recovery from piston<br>= power output<br>= combustion energy in chamber 4 |
| 3 | | Fuel type<br><br>Knock signal at a previous cycle<br><br>Target compression ratio at a previous cycle | (Computed) | Target compression ratio this cycle (Control signal) |
| 4 | | Air admission to chamber 3<br><br>Desired EGR% | (Computed) | Target exhaust valve closure point (Control signal) |
| 5 | Equalisation & Scavenging phases | Piston kinetic energy (computed from coils output)<br><br>Target exhaust valve closure point | (Computed) | Kinetic energy error calculated based on actual KE vs. theoretical KE to achieve target compression ratio and rate (Control signal) |
| 6 | | Kinetic energy error | Coils | Adjust force so that change in kinetic energy recovery from piston is equal to and negates Kinetic energy error signal |
| 7 | Compression phase | Piston kinetic energy (computed from coils output)<br><br>Piston position<br><br>Air, fuel & exhaust gas in combustion chamber<br><br>Timing of exhaust gas closure | (Computed) | Expected compression ratio (control signal) |
| 8 | | Expected compression ratio | Ignition timing control means | Timing optimised for expected compression ratio |

FIG. 9a

FREE PISTON ENGINE

CROSS REFERENCE TO RELATED APPLICATION

The present application is the U.S. national stage application of International Application PCT/GB2010/052123, filed Dec. 17, 2010, which international application was published on Jun. 30, 2011, as International Publication WO 2011/077119. The International Application claims priority of British Patent Application 0922539.2, filed Dec. 24, 2009, the contents of which are incorporated herein by reference in their entireties.

The present invention relates to a free piston engine and in particular a free piston engine with an electrical power generation system.

It is known to use internal combustion engines to generate electrical power. Furthermore, a number of systems for generating electrical power exist that use a linear generator coupled to a free piston engine, wherein the linear movement of the reciprocating piston through one or more electrical coils generates magnetic flux change, for example U.S. Pat. No. 7,318,506.

However, the efficiency of such an electrical power generation system is highly dependent on the efficiency of the free piston engine driving it and therefore a free piston engine having good efficiency is highly desirable.

Previously, free piston engines have been provided with both an inlet means and exhaust valve within each combustion chamber in close proximity to the ends of the cylinder, for example U.S. Pat. No. 6,199,519. As a result of the intake means being located near to the exhaust valve in the combustion chambers of the engine, scavenging inside the combustion chamber is generally achieved by loop scavenging. This results in incomplete scavenging, and in addition some intake charge mixture may be entrained with exhaust gases giving poor hydrocarbon emissions performance.

Previously, two-stroke engine embodiments used in small vehicle applications attained a compression ratio that is approximately equal to the expansion ratio in order to achieve the highest intake charge and output power per unit engine mass. A consequence of this arrangement is that the expansion stroke is terminated by exhaust valve opening before the gases have fully expanded and when there remains a significant pressure differential between the expanding combustion chamber and the exhaust manifold. This results in engine efficiency losses and also causes significant noise emissions.

In the present invention the expansion ratio is approximately two times the compression ratio. At compression ratios of between 10:1 and 16:1 this delivers an efficiency improvement of 10-20%. The specific power loss that normally accompanies this type of over-expansion cycle is mitigated by use of an elongated cylinder bore. The part of the cylinder bore that is required for continuing the piston over-expansion in one chamber also serves as the part of the cylinder required for the initial expansion of the opposing chamber. In this way, an overexpansion cycle is attained with very little additional mass and without sacrificing intake charge volume.

According to the present invention there is provided a free-piston engine comprising an engine cylinder and a single piston member comprising a double-ended piston configured to move within the cylinder, wherein the piston member partitions the cylinder into two separate combustion chambers, each of which are supplied with a compressible working fluid from one or more intake means, the piston being arranged to move over and past the intake means during each stroke such that the fluid is replenished within one combustion chamber while the piston compresses the fluid held in the other combustion chamber.

By allowing the piston to move over and past the intake means, an overexpansion of the combustion chamber gases is achieved without requiring significant additional engine size or weight, since the cylinder bore used for the overexpansion motion is shared with the opposing combustion chamber. Similarly, the intake means are shared with both combustion chambers giving an efficient and compact engine with low cost.

Preferably, the intake means are located at a central position along the cylinder, which simplifies the engine arrangement by allowing the intake into each combustion chamber to be controlled by the position of the piston within the cylinder. Furthermore, by positioning the intake means at a position removed from the exhaust valve, scavenging can be greatly improved within the combustion chamber, which in turns results in improved efficiency and improved emissions.

Preferably the intake means comprises both an air intake means and a fuel injection means, so that fuel injection into a combustion chamber may occur during the admission of intake charge air. Providing the air intake means and fuel injection means together in the intake means allows both these features to share a common sliding port valve, each being recessed within the void behind this sliding port valve. This results in a simpler and hence cheaper construction.

Preferably the air intake means comprises a sliding port valve and a solenoid poppet valve arranged in series. The poppet valve can allow air into the chamber at any time when the sliding port valve is uncovered by the piston, which allows good control of the expansion ratio in response to a combustion event, independently of the position of the piston within the limits defined by the opening and closing positions of the sliding port valve.

Preferably the fuel injection means comprises two injectors arranged one on each side of the air intake poppet valve to allow fuel to be injected directly into the respective chamber independently of whether the intake poppet valve is open or closed. The two injectors are, preferably, piezo-injectors to provide precise, low cost electronic actuation and control of the fuel injection Preferably, the fuel injection means is configured to inject fuel immediately prior to the closing of the slide valve to ensure that fuel injected cannot be carried to and out of the exhaust port by scavenging air intake charge before the exhaust valve is closed, reducing hydrocarbon (HC) emissions.

Preferably, spark ignition means are provided in each chamber to produce a spark to initiate combustion of the air-fuel mixture injected. Use of spark ignition fuels and their related operating cycles inherently generate less particulate emissions than compression ignition fuels and cycles.

Preferably, an exhaust means is provided in each combustion chamber to allow for burnt gases to be exhausted from the chamber following combustion.

Preferably, the exhaust means is a solenoid poppet valve provided in each combustion chamber, with the valves being coaxial with the cylinder such that the limiting area in the exhaust flow may approach 40% of the cylinder bore section area, reducing exhaust gas back-pressure during exhaust and scavenging.

Preferably, the cylinder has a length at least ten times greater than its diameter, which provides reduced variability of compression ratio in each cycle, resulting from a low rate of change of compression ratio with piston displacement error at top dead centre.

Preferably, the piston is configured to be elongate and the engine cylinder has a bore dimensioned such that a compression ratio of between 10:1 and 16:1 can be achieved. This is higher than can be achieved in a conventional spark ignition engine due to detonation (knocking). Preferably, the engine is a 'flex-fuel' engine operating on any mixture of gasoline, anhydrous ethanol and hydrous ethanol. The compression ratio may be optimised by the engine management system according to the particular ethanol/gasoline/water blend that is used.

Also, an expansion ratio greater than twice the compression ratio is obtained. A long expansion stroke allows more of the combustion energy to be transferred into the piston, and in addition allows more time for control (i.e. to react to measured piston speed variability).

Preferably, the intake means is positioned a suitable distance from the exhaust valve to ensure that a compression ratio of between 10:1 and 16:1 can be achieved.

According to the present invention there is also provided a vehicle having a free piston engine as described above.

According to the present invention there is also provided an engine generator in the form of a transverse flux linear switched reluctance machine comprising an engine as described above and further comprising a plurality of coils and stator elements positioned along at least a portion of the length of the cylinder, wherein movement of the piston within the cylinder past the coils interacts with a switched magnetic flux within the stator elements to generate electrical power that can be used for useful work or stored for later use.

A transverse flux linear switched reluctance machine is particularly useful for generating electrical power by inducing magnetic flux as described above.

An alternative type of electrical machine that may be used is a transverse flux linear switched flux machine, in which DC coils or permanent magnets contribute to the flux in each magnetic circuit.

According to the present invention there is also provided a vehicle having an engine generator as described above.

The engine of the present invention can be used with a combustion management system for a combustion engine having at least one cylinder with an intake means comprising a sliding port valve and an intake solenoid poppet valve arranged in series and provided at a distance from the cylinder ends, and an exhaust solenoid poppet valve provided at each of the cylinder ends. An example of such a combustion management system comprises:

a valve control means for controlling the intake solenoid poppet valve and the exhaust solenoid poppet valve independently of the position of the piston moving within the cylinder to control the compression and expansion ratios, wherein the piston moves over and past the intake means during each stroke.

By controlling the opening timing of the intake valves and the closing timing of the exhaust valves, the compression and expansion ratios can be controlled to optimise the efficiency of the engine.

Preferably, when the piston member is at the extremity of its movement within the cylinder, the clearance between the piston end and a cylinder head provided at the end of the cylinder is more than half the diameter of the piston to provide a combustion chamber form with a low surface area-to-volume ratio at top dead centre, which results in reduced heat loss at top dead centre giving an approximately adiabatic cycle with minimum exhaust heat rejection.

In addition, the size of the combustion chamber effectively acts as an air spring to absorb variations in energy of the approaching piston without engine damage. Such variations may arise due to combustion variability in the opposing combustion chamber, and other sources of variability. The consequence of these variations is a higher or lower compression ratio than targeted by the compression ratio control means.

Preferably, a spark ignition control means is provided for adjusting the spark timing so that the adverse impact of compression ratio variability on engine emissions and efficiency are reduced.

Preferably, the valve control means is configured to control the opening of the intake valve and exhaust valve independently to allow for control of exhaust gas recirculation (EGR), intake charge and compression ratio.

Preferably, the intake valve is independently controlled to open at the end of the expansion stroke and for a defined period while the sliding port valve remains open to admit the desired quantity of intake charge for the next combustion event. Controlling the intake charge in this way avoids the need for a separate throttle and thereby increases engine efficiency by reducing throttling losses.

Preferably, a fuel sensor is provided to determine the type of fuel that is to be used in the engine.

Preferably an air flow sensor and an exhaust gas sensor are provided to determine the amount of fuel to inject into each chamber according to the quantity of air added and the type of fuel used.

Preferably, the fuel injection control means is configured to control the fuel injection means to inject fuel into a combustion chamber immediately prior to the sliding port valve closing to reduce hydrocarbon (HC) emissions during scavenging.

Preferably, a knock sensor is also provided to output combustion detonation and auto-ignition readings to the compression ratio control means to ensure that optimum compression ratios are achieved for the type of fuel being used by closed loop control of exhaust valve timing.

Preferably, the system also comprises a plurality of coils and stator elements positioned along the cylinder, wherein movement of the piston within the cylinder past the coils interacts with a switched magnetic flux within the stator elements to generate electrical power that can be used for useful work or stored for later use.

Preferably, the position of the piston within the cylinder can be determined from the electrical output of the coils.

Preferably, the compression ratio control means can control the coils to limit the movement range of the piston by modulation of the magnetic force applied to the piston, and hence adjust the kinetic energy of the piston around the time of the exhaust valve closure and during the piston's approach to the top dead centre position so that the desired compression ratio is achieved.

Preferably, a plurality of temperature sensors are provided in proximity to the coils, electronic devices and other elements sensitive to high temperatures for providing readings to the temperature control means.

Preferably, the temperature control means acts to increase the flow of cooling air in the cooling means in response to increased temperatures.

Preferably, the temperature control means also provides an input to the valve control means so that the engine power output is reduced when sustained elevated temperatures are recorded to avoid engine damage.

The present invention has a number of applications. For example, it may be integrated in a series-hybrid electric vehicle power train incorporating a transient electrical power store and one or more drive motors suitable for use as an automotive power source in small passenger vehicles, wherein electrical power generated by the free piston engine is accumulated in an electrical energy storage device on board the vehicle to be delivered to the vehicle drive motors on demand.

As a power source for a small passenger vehicle the present invention preferably runs on a two-stroke engine cycle with spark ignition, with four cylinders being arranged in a planar configuration such that the engine might be transverse mounted beneath the front or rear seats of the vehicle, offering significantly more design flexibility to the layout of the passenger and storage spaces compared to a conventional internal combustion engine.

Each cylinder includes a free piston whose movement induces electrical power in a linear generator arranged around each cylinder, and whose movement is controllable by various means including the timing of valve and ignition events, and by modulation of the power drawn from or supplied to the piston on each stroke. The movement of pistons is synchronised such that the engine is fully balanced.

Furthermore, each cylinder is charged by means of an intake mechanism that introduces fluid into the cylinder at a position distal from each end of the cylinder. The intake mechanism includes a poppet valve and sliding port valve in series such that the timing of the intake flow events may be controlled independently of the piston positions relative to the cylinders. Exhaust gas leaves the cylinders from exhaust valve mechanisms located at the end of each cylinder.

The geometry of the cylinder and disposition of the intake and exhaust mechanisms are such that the exhaust scavenging is completed with limited mixing between intake fluid and exhaust fluid. The combustion chamber geometry offers a low surface area-to-volume ratio, and low conductivity materials are used in the piston crown and cylinder head, so that minimal heat is rejected from the engine. The cylinder and piston geometry provides an expansion ratio which is at least two times the compression ratio.

The arrangement, and number, of cylinders used is, however, dependent on the application and the engine operating cycle can also be varied for different applications, for example: spark ignition internal combustion; homogeneous charge compression ignition internal combustion; and heterogeneous charge compression ignition. Some of the features of the present invention may also be embodied with an external combustion cycle, such as the Stirling cycle. In this type of engine, heat from an external combustion source is supplied to the chamber containing compressed working fluid at top dead centre. After expansion, the exhaust gases are expelled to a closed cooling chamber before being readmitted to the chamber through the intake means in a closed circuit.

The fuel in various alternative embodiments may be hydrous ethanol, anhydrous ethanol-gasoline blends, or gasoline. The invention may also be embodied as using diesel, bio-diesel, methane (CNG, LNG or biogas) or other gaseous or liquid fuels. In an external combustion embodiment a wide range of combustible fuels may be used.

Accordingly, in conjunction with an energy storage system to provide peak transient power output requirements, the present invention provides a low-cost, high efficiency power supply for small passenger vehicle automotive applications, and many other applications where low cost and high efficiency are key design considerations, for example as a static power generator for distributed power generation.

An example of the present invention will now be described, with reference to the accompanying figures, in which.

Figure 5A:
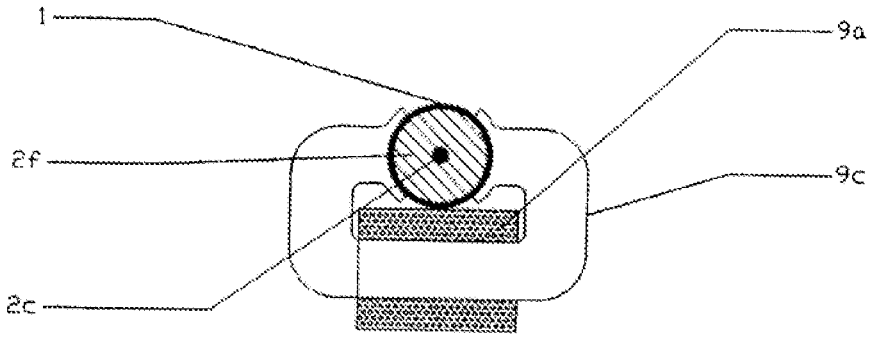
Figure 5B:
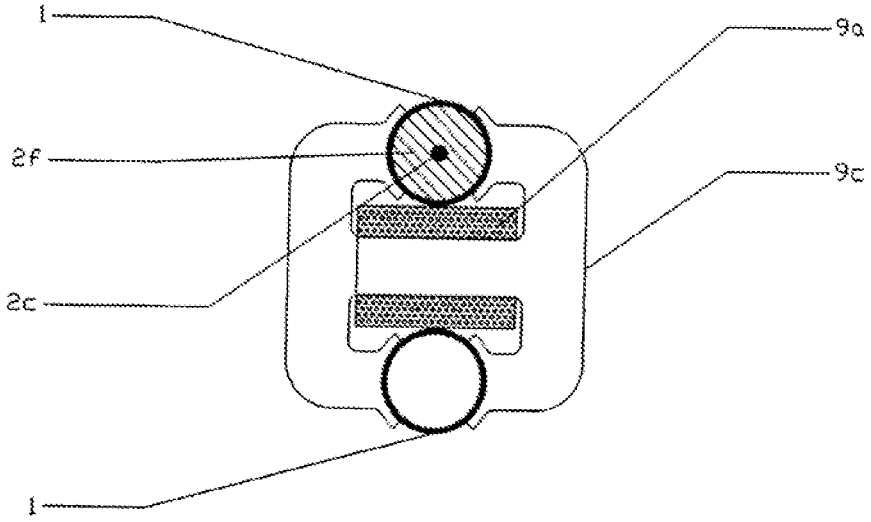
Figure 6:
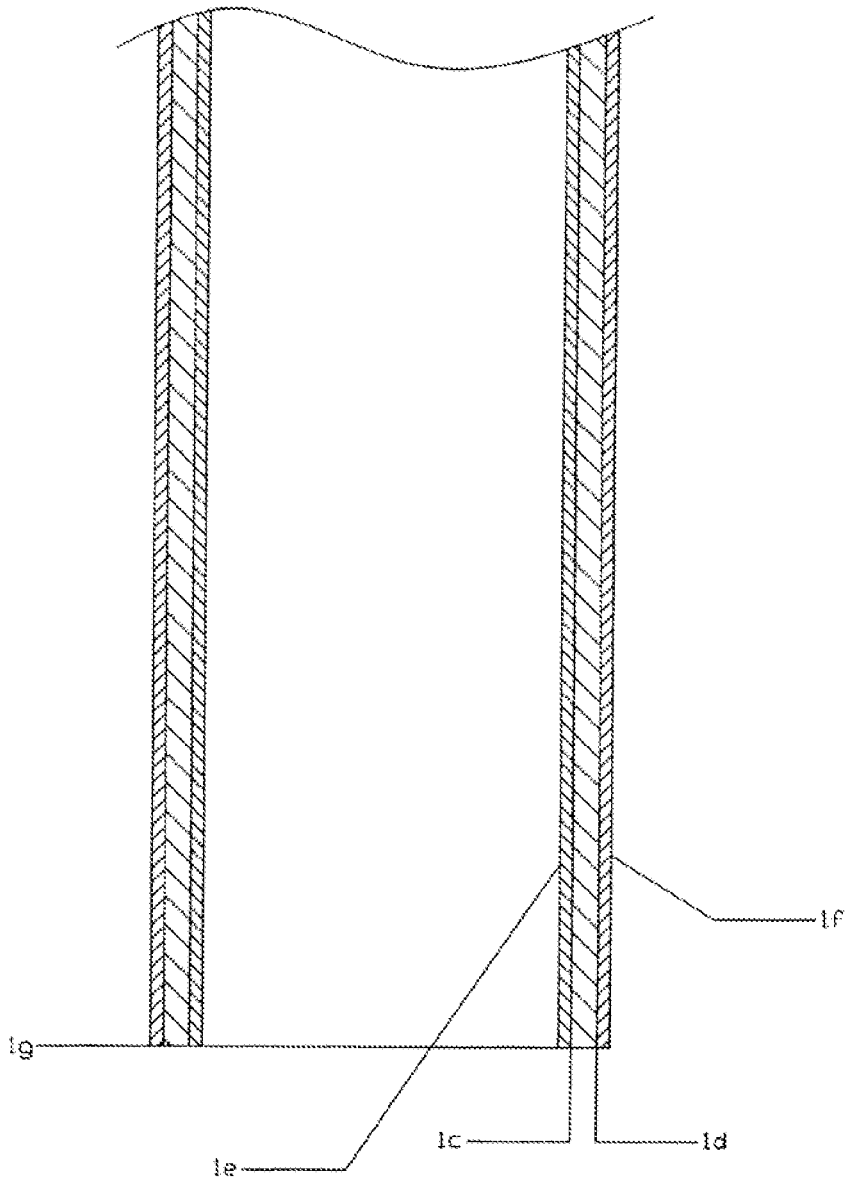
Figure 7:
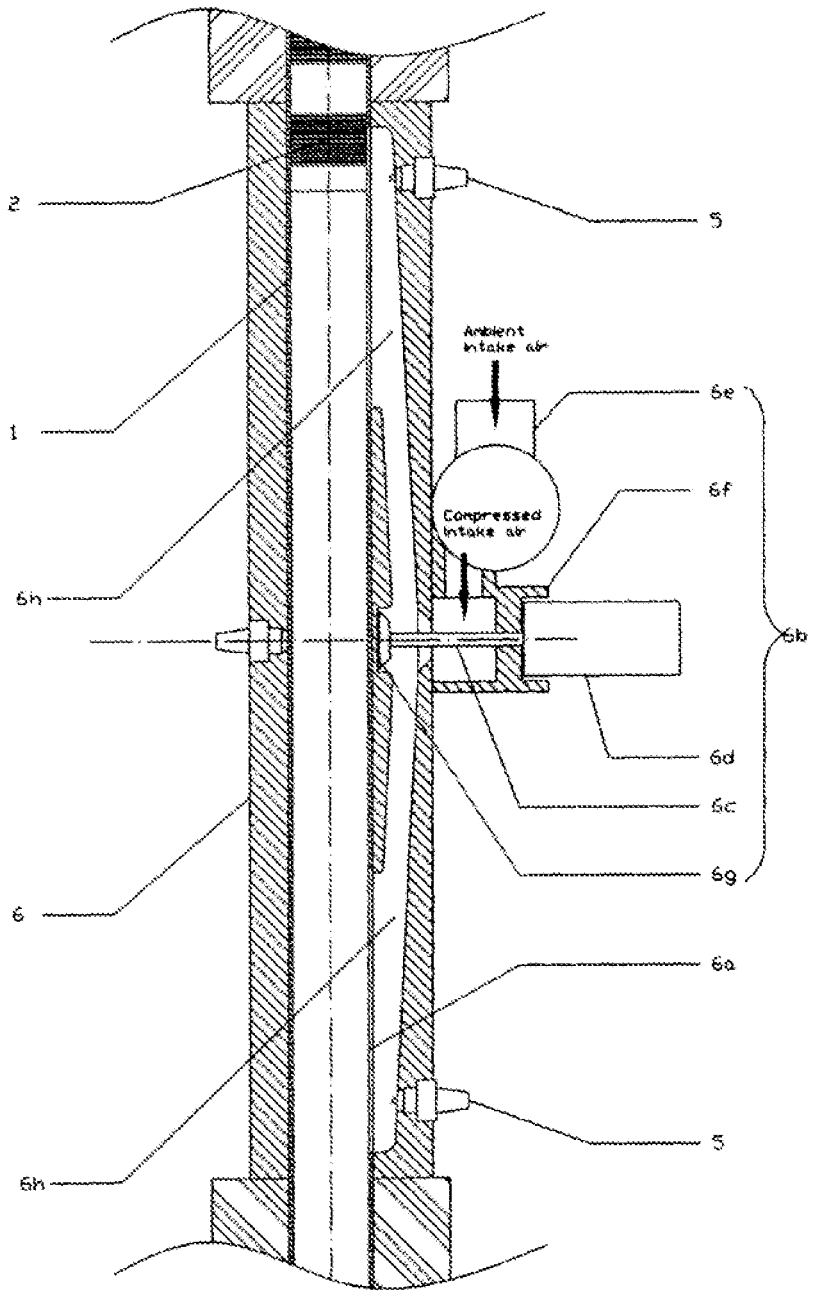
Figure 8:
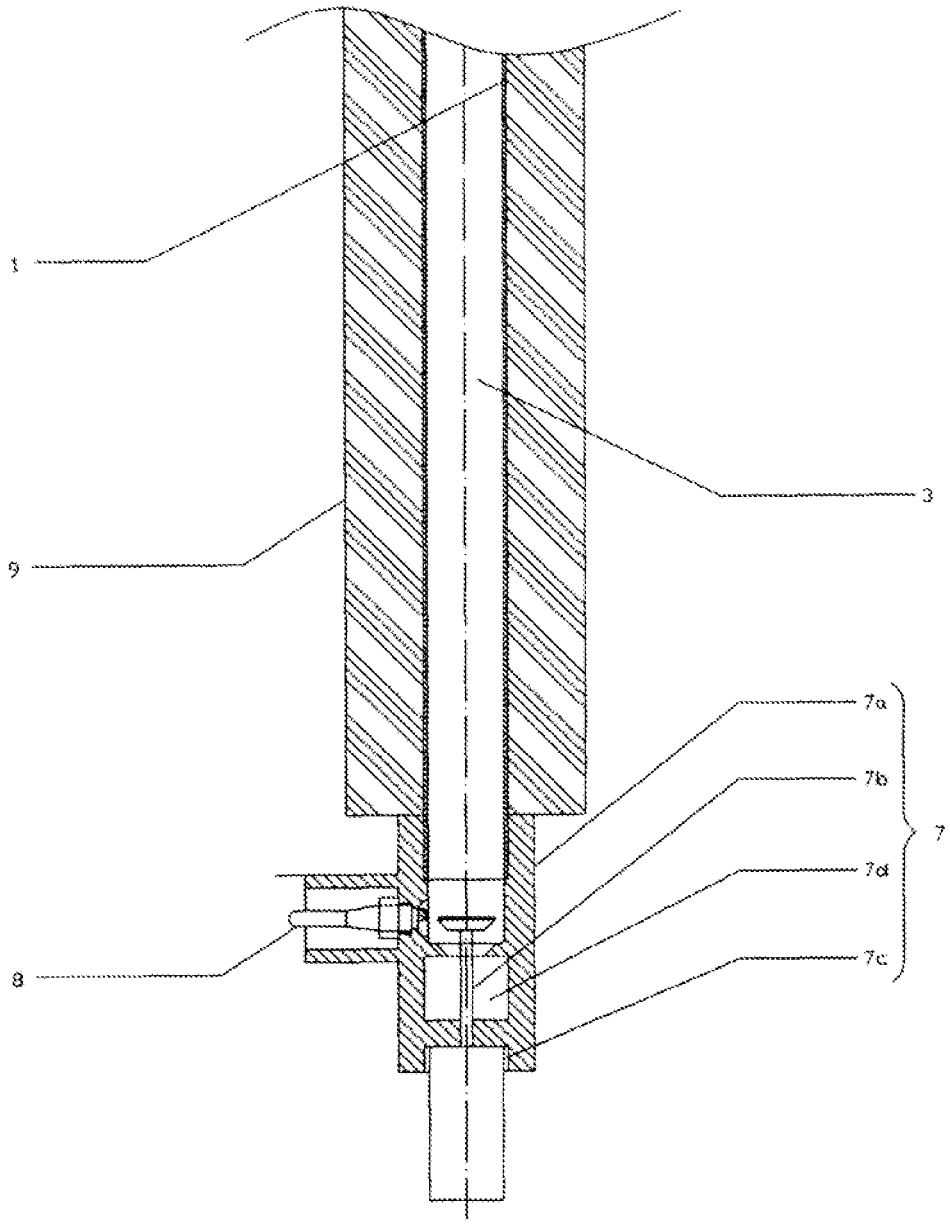
Figure 9:
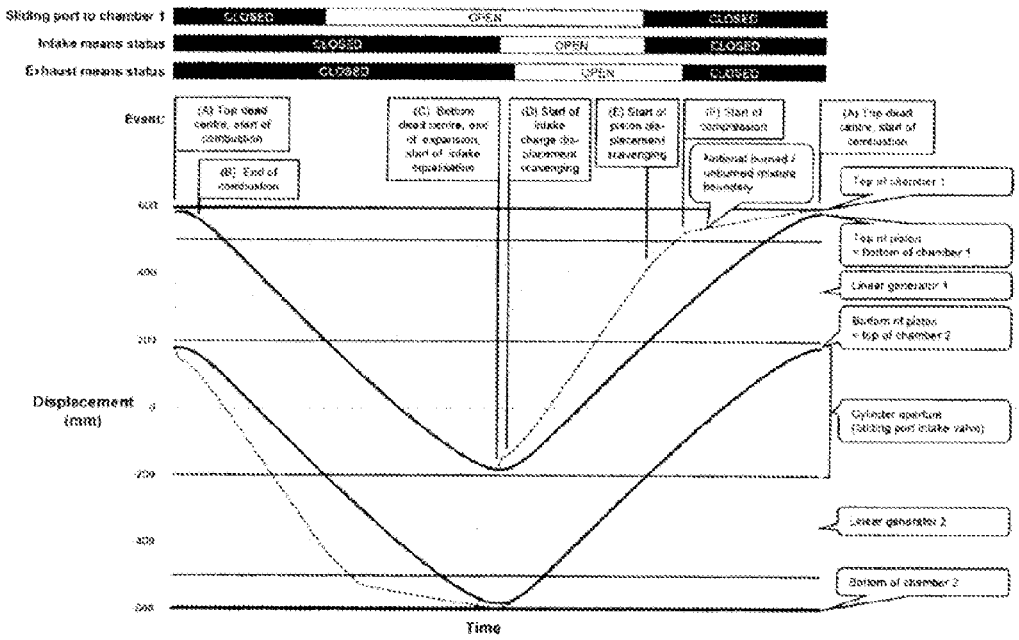
Figure 9B:
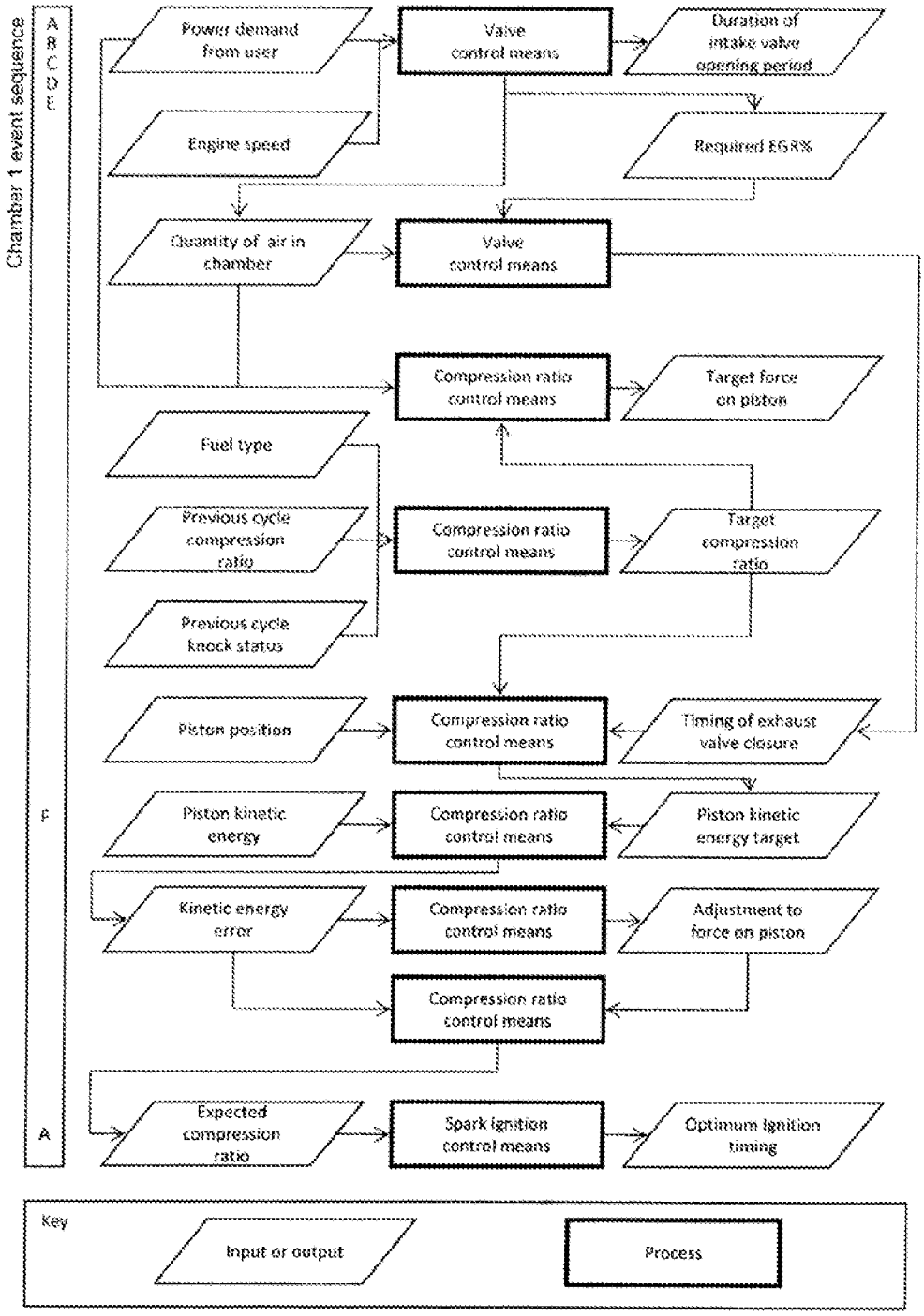
Figure 10:
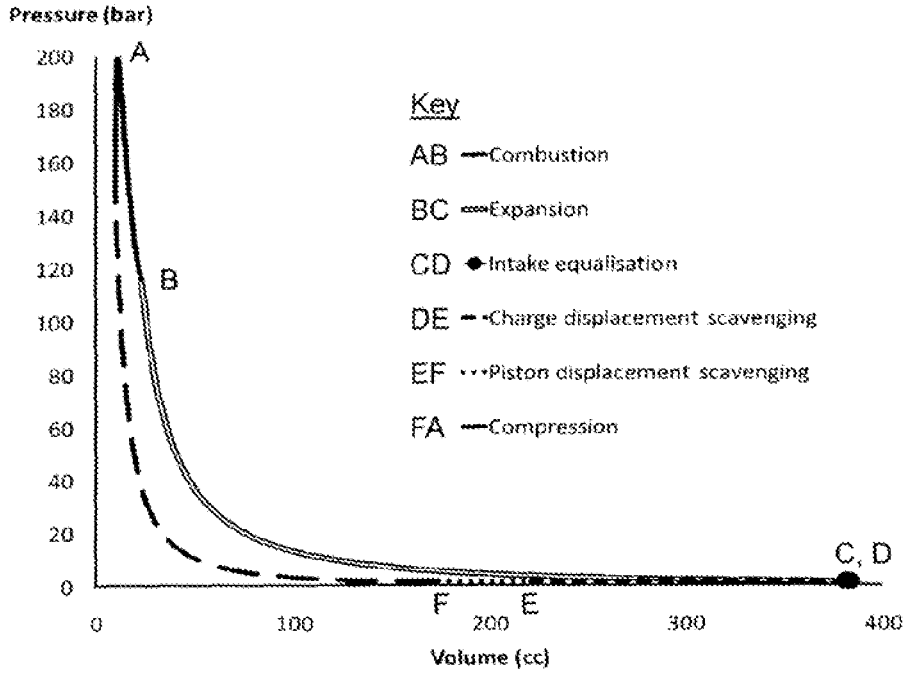
Figure 11:
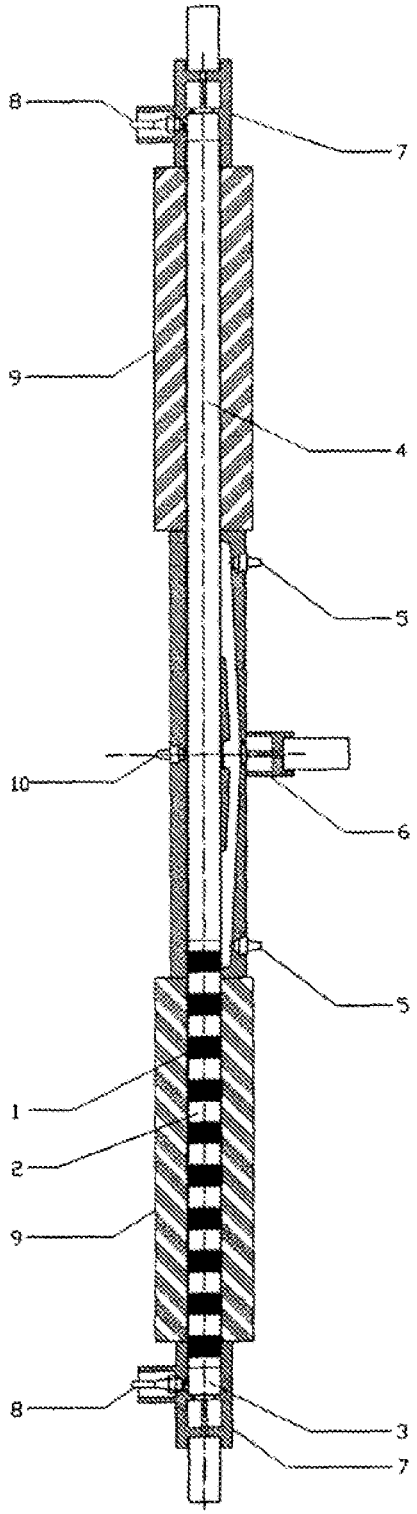
Figure 12:
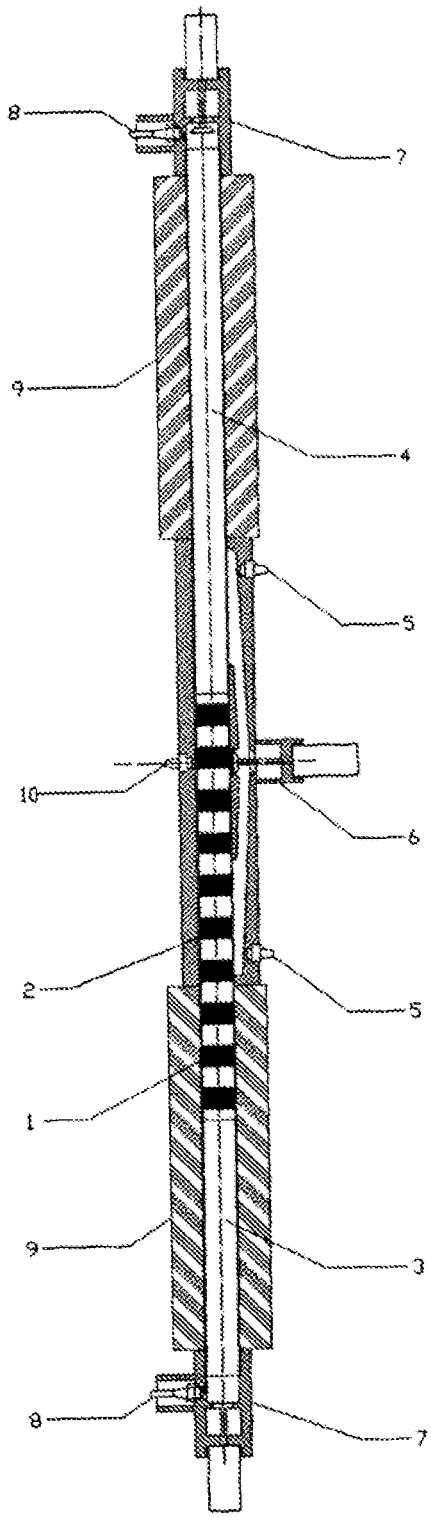
Figure 13:
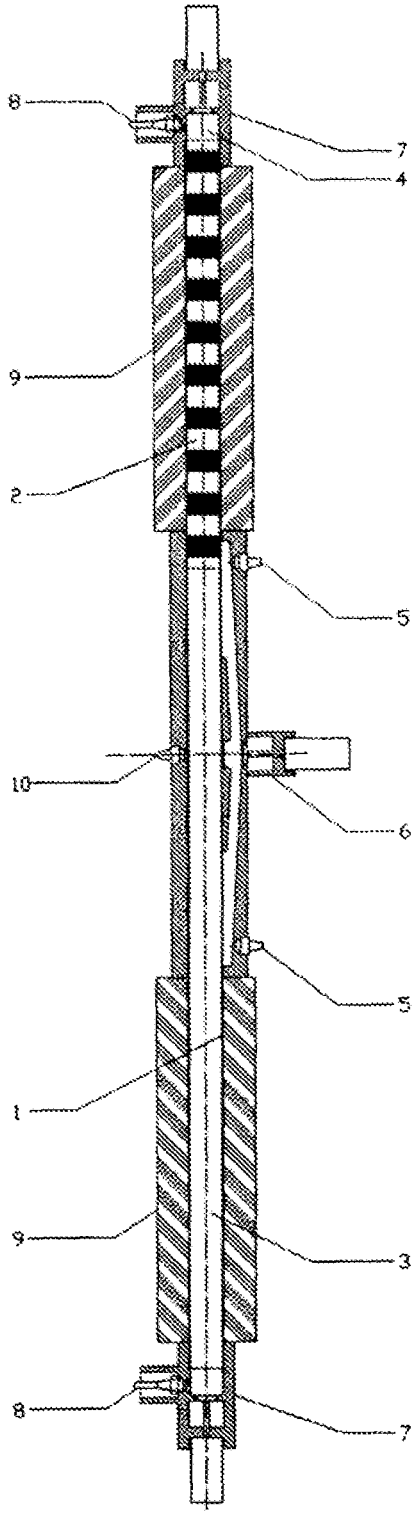
Figure 14:
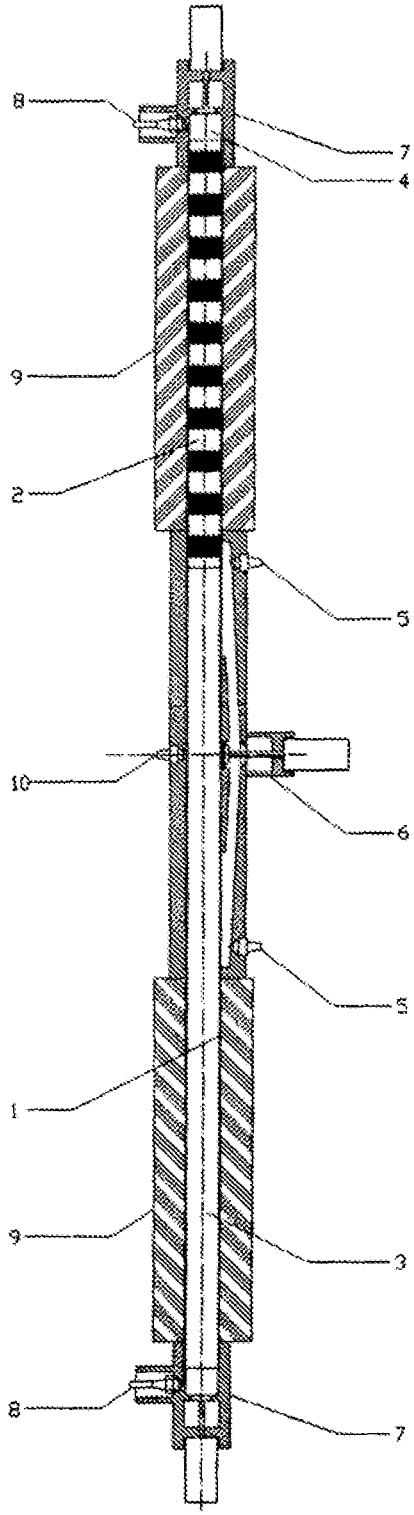
Figure 15:
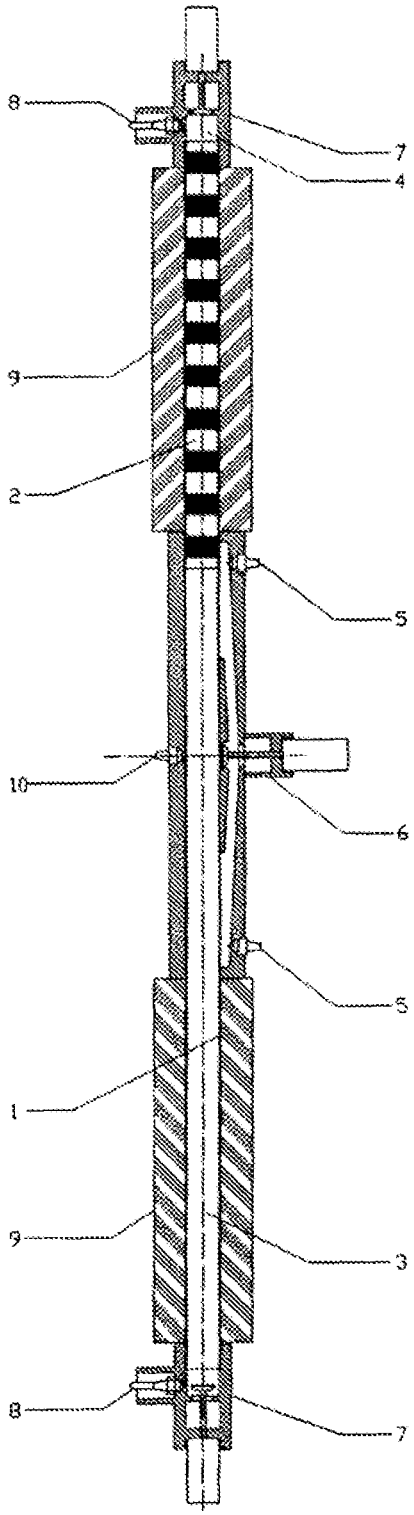
Figure 16:
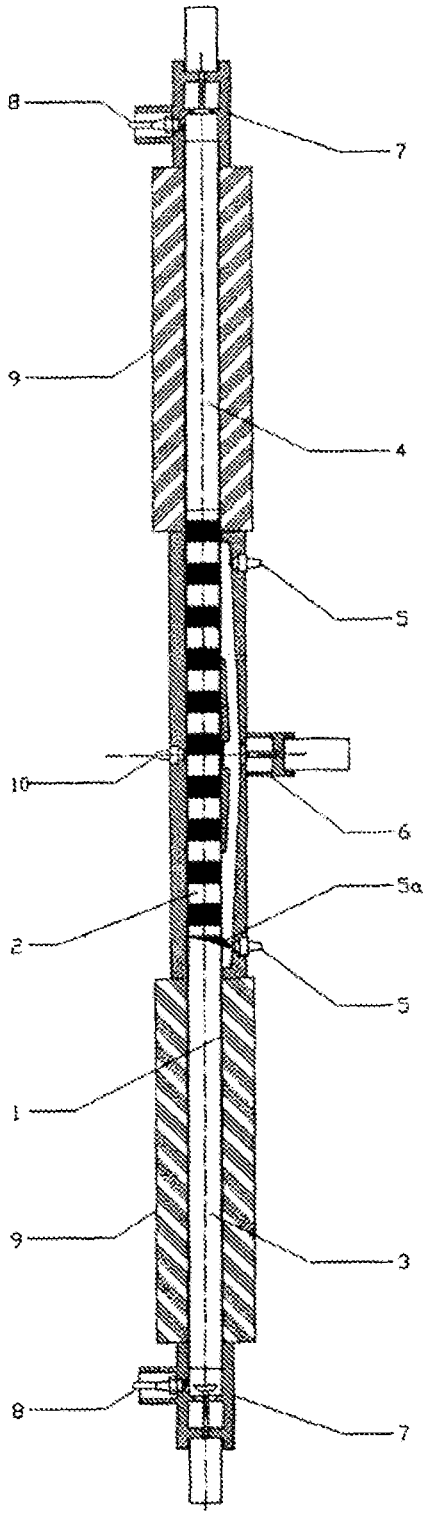
Figure 17:
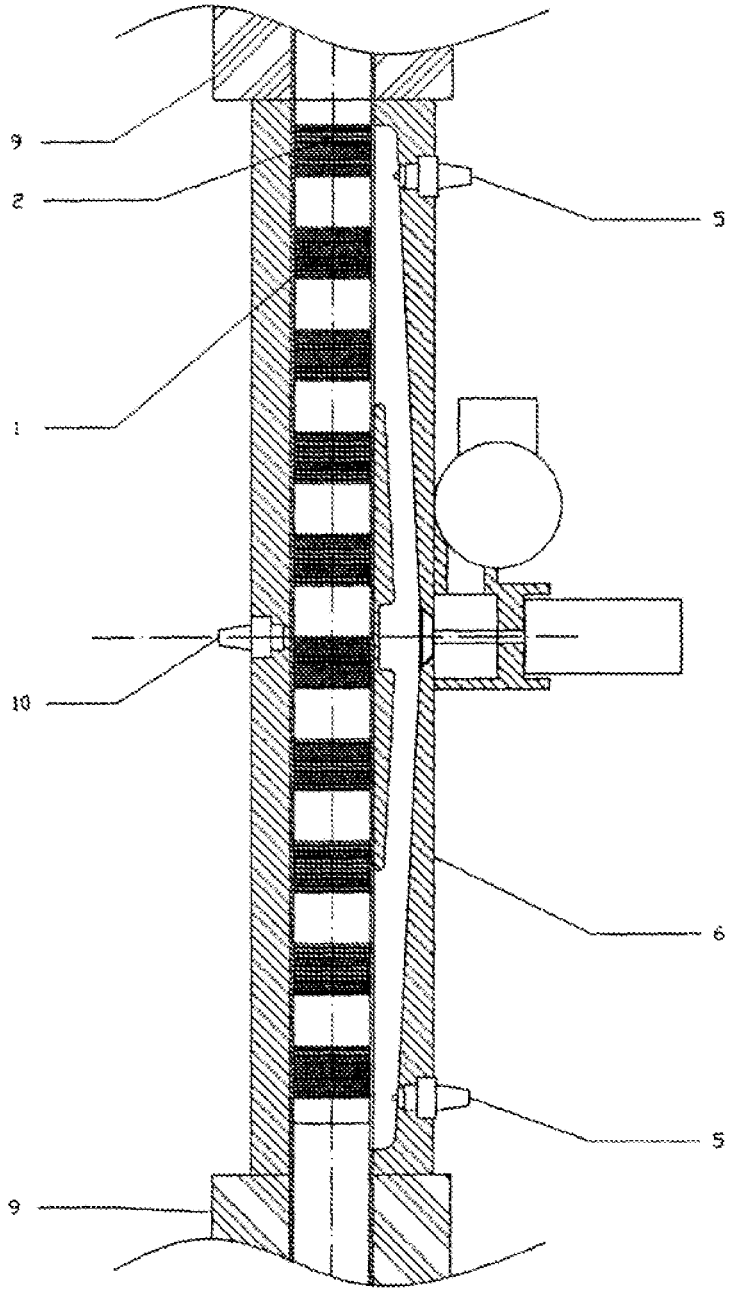
Figure 18:
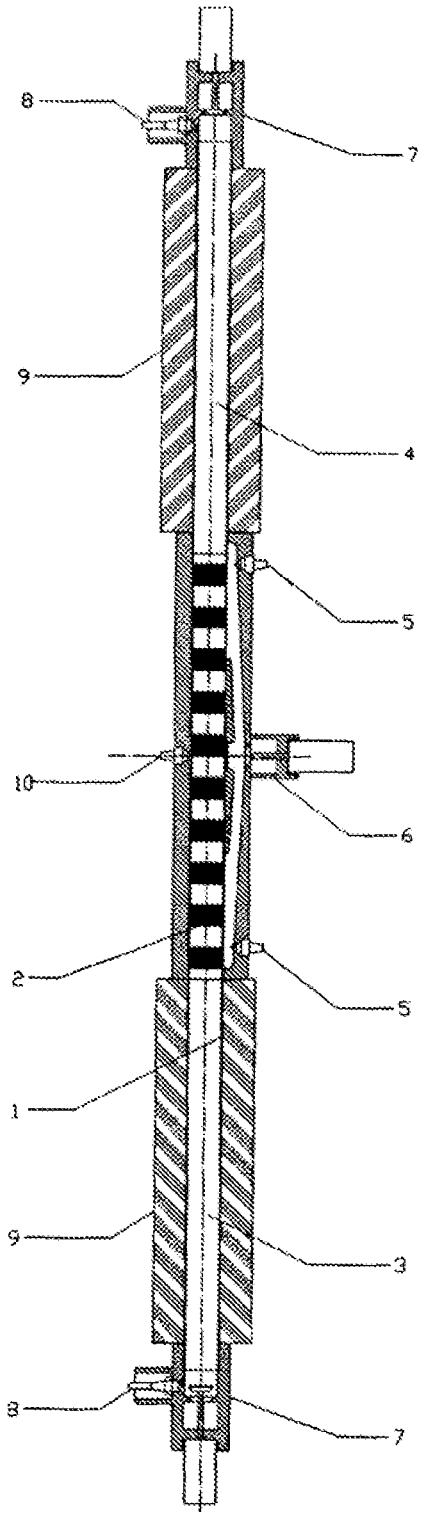
Figure 19:
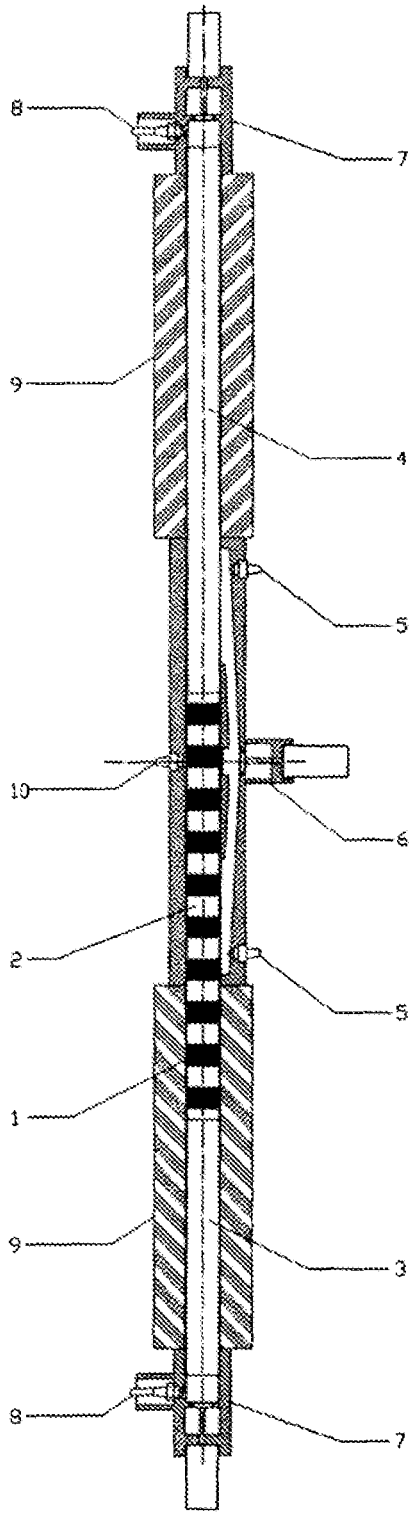
Figure 20:
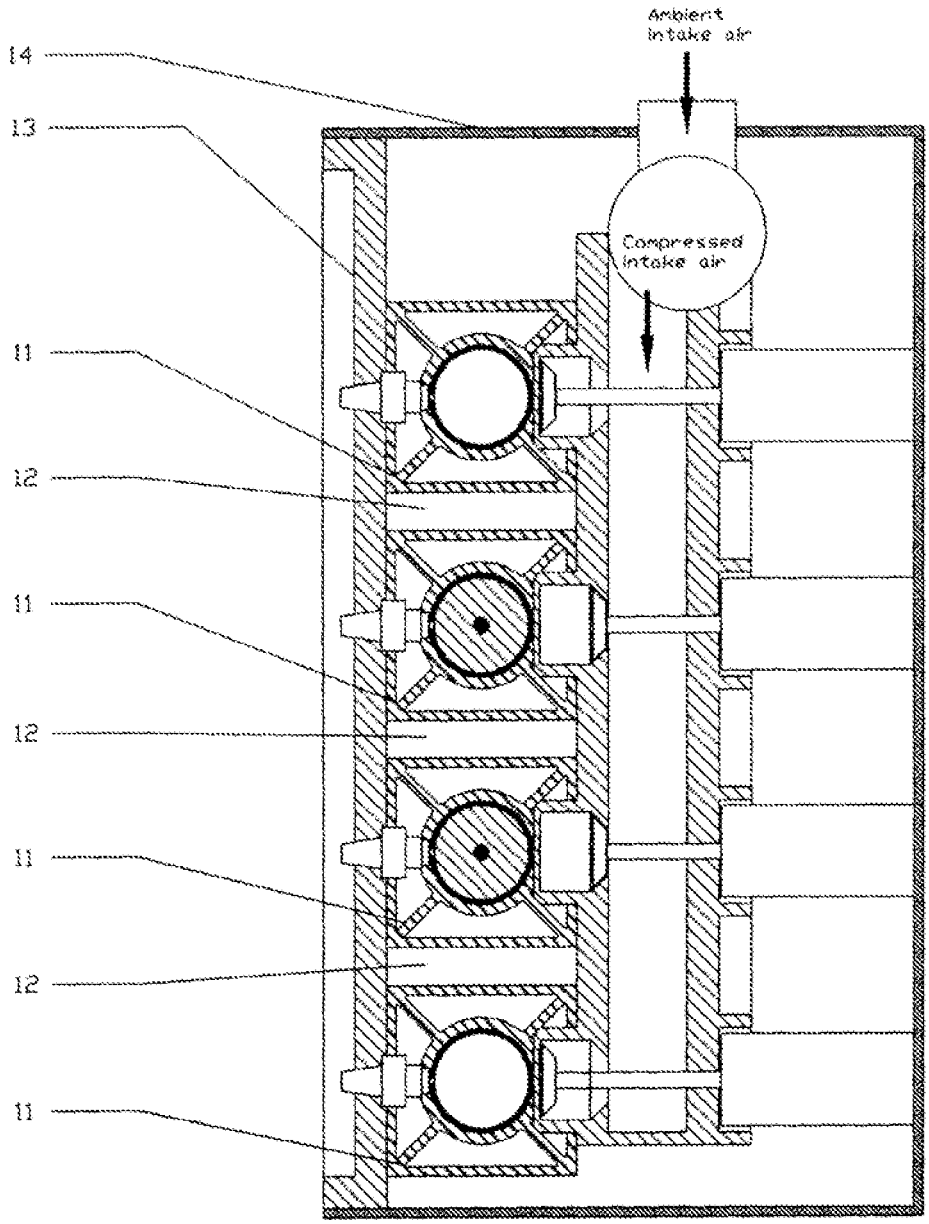
Figure 21:
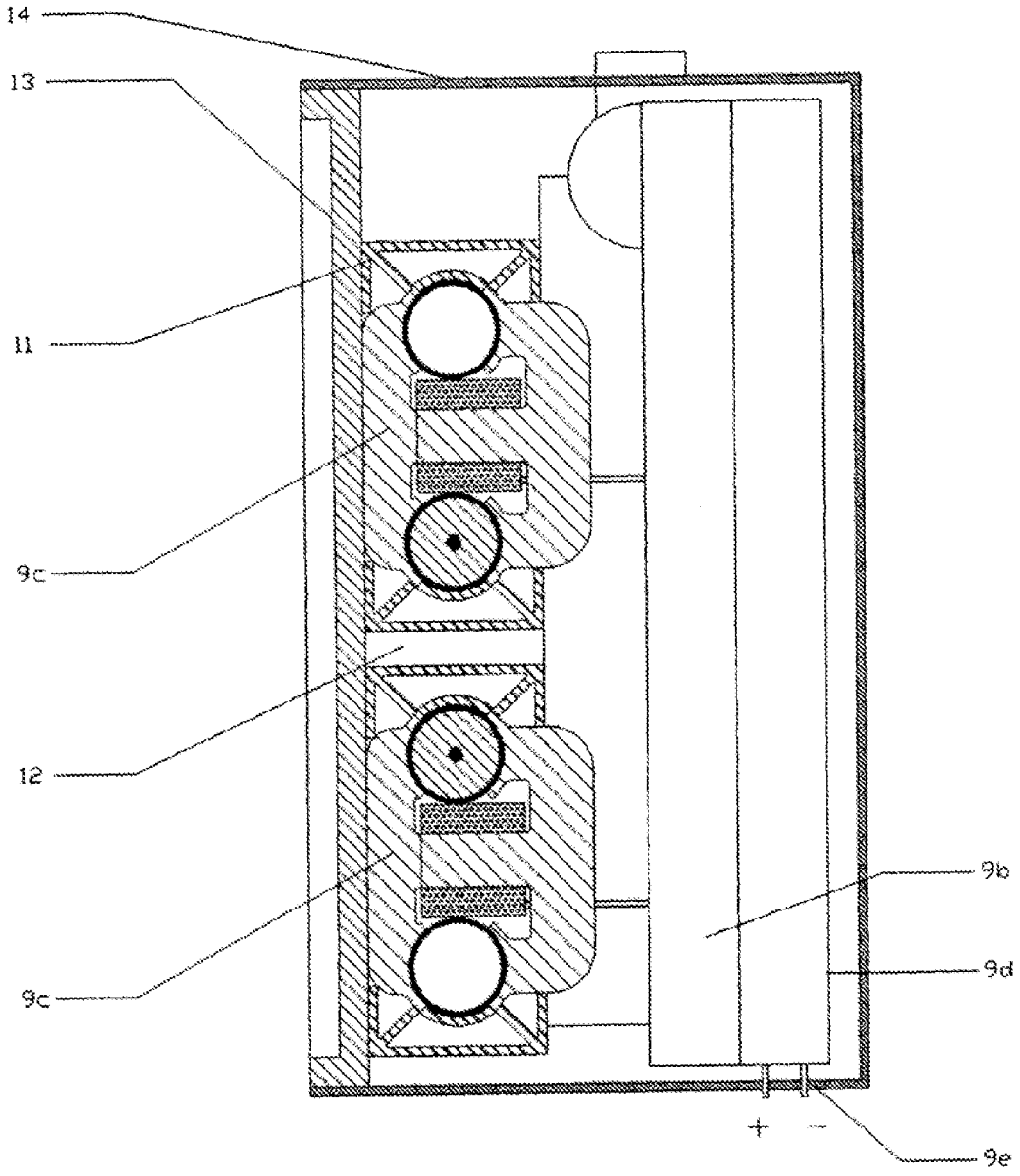
Figure 22:
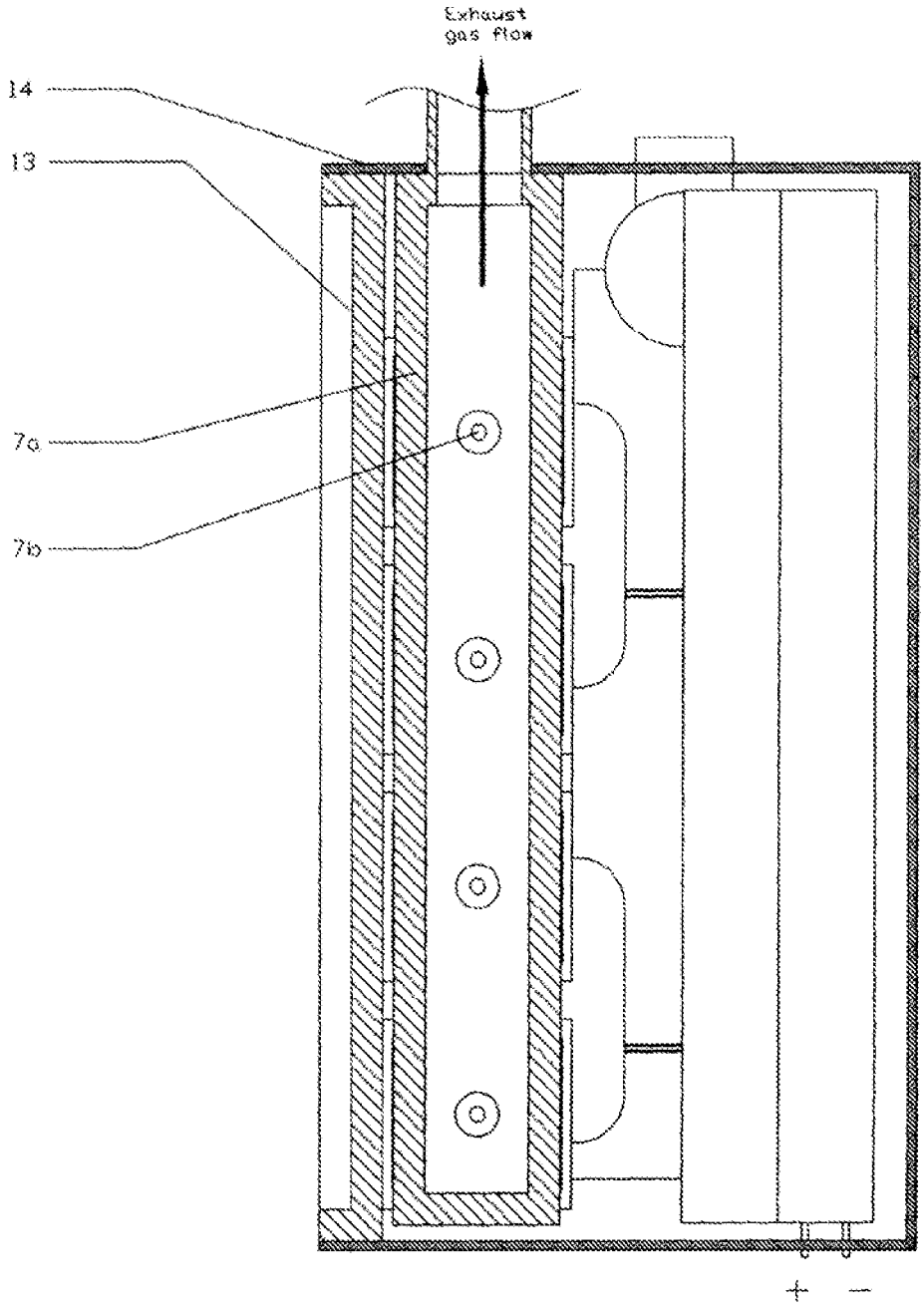

FIG. 5*a* is a perpendicular section through a cylinder showing the linear generator stator and the magnetic circuit formed by a permeable element in the first piston;

FIG. 5*b* is a perpendicular section of an alternative linear generator stator arrangement for two adjacent cylinders wherein the linear generator stator and the magnetic circuit are formed by a permeable element in the first piston;

FIG. 6 is a partial sectional view of the cylinder illustrating its construction;

FIG. 7 is a more detailed longitudinal section of the intake poppet valve, intake port valve and fuel injector arrangement during the intake charge displacement scavenging phase;

FIG. 8 is a more detailed longitudinal section of the exhaust means including the exhaust poppet valve and actuator during the exhaust phase;

FIG. 9 is a time-displacement plot showing the changing piston position within a cylinder during a complete engine cycle, and the timing of engine cycle events during this period;

FIG. 9*a* is a table showing different compression ratio control means that may be employed to control the compression ratio in a typical engine cycle;

FIG. 9*b* is a flow chart showing an exemplary compression ratio control sequence;

FIG. 10 is a pressure-volume plot showing a typical cylinder pressure plot during a complete engine cycle;

FIG. 11 is a schematic longitudinal section through a cylinder at top dead centre, at the end of the compression phase and around the time of spark ignition and initiation of the combustion event in the first chamber;

FIG. 12 is a schematic longitudinal section through a cylinder mid way through the expansion phase of the first chamber;

FIG. 13 is a schematic longitudinal section through a cylinder at the end of the expansion phase, but before the intake poppet valve has opened;

FIG. 14 is a schematic longitudinal section through a cylinder following the opening of the intake poppet valve to charge chamber 1, allowing intake charge fluid pressure to equalise the lower cylinder pressure in the first chamber;

FIG. 15 is a schematic longitudinal section through a cylinder following the opening of the exhaust poppet valve, and whilst the intake poppet valve remains open, scavenging the first chamber;

FIG. 16 is a schematic longitudinal section through a cylinder during fuel injection into the first chamber after the intake poppet valve has closed;

FIG. 17 is a schematic longitudinal section through a cylinder during lubricant injection onto the piston outer surface;

FIG. 18 is a schematic longitudinal section through a cylinder whilst the exhaust poppet valve is open, and after the intake poppet valve and sliding port valve have closed such that continuing expulsion of exhaust gases from the first chamber is achieved by piston displacement;

FIG. 19 is a schematic longitudinal section through a cylinder mid way through the compression phase in the first chamber;

FIG. 20 is a schematic perpendicular section through a four cylinder engine construction through the intake means including the electrical charge compressor;

FIG. 21 is a schematic perpendicular section through a four cylinder engine construction through the electrical generator means; and FIG. 22 is a schematic perpendicular section through a four cylinder engine construction through the exhaust means.

Figure 1:
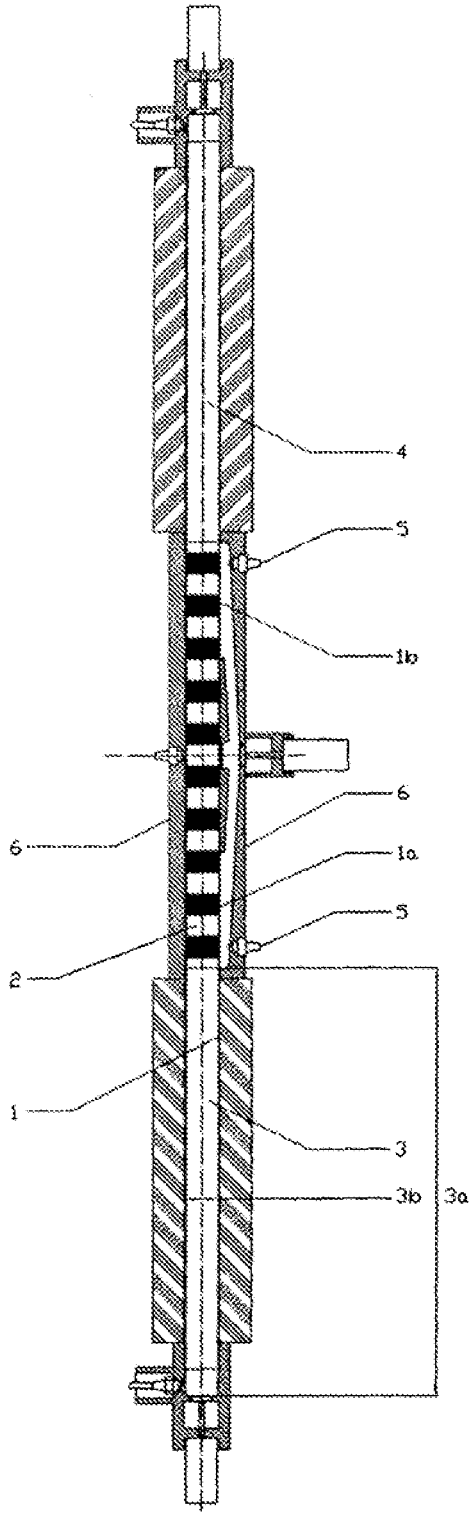
FIG. 1 shows a longitudinal section through a cylinder having a piston according to an example of the present invention.

FIG. 1 shows an example of the present invention, comprising a hollow linear cylinder 1. A piston 2 is provided within the cylinder 1, the piston 2 having a constant diameter that is configured to be slightly smaller than the inside diameter of the cylinder 1, but only to the extent that the piston 2 is free to move along the length of the cylinder 1. The piston 2 is otherwise constrained in coaxial alignment with the cylinder 1, thereby effectively partitioning the cylinder 1 into a first combustion chamber 3 and a second combustion chamber 4, each chamber having a variable volume depending on the position of the piston 2 within the cylinder 1. No part of the piston 2 extends outside the cylinder 1. Using the first chamber 3 as an example, each of the chambers 3, 4 has a variable height 3*a* and a fixed diameter 3*b*.

The cylinder 1 is, preferably, rotationally symmetric about its axis and is symmetrical about a central plane perpendicular to its axis. Although other geometric shapes could potentially be used to perform the invention, for example having square or rectangular section pistons, the arrangement having circular section pistons is preferred. The cylinder 1 has a series of apertures 1*a*, 1*b* provided along its length and distal from the ends, preferably in a central location. Through motion of the piston 2, the apertures 1*a*, 1*b* form a sliding port intake valve 6*a*, which is arranged to operate in conjunction with an air intake 6*b* provided around at least a portion of the cylinder 1, as is described in detail below.

Figure 2:
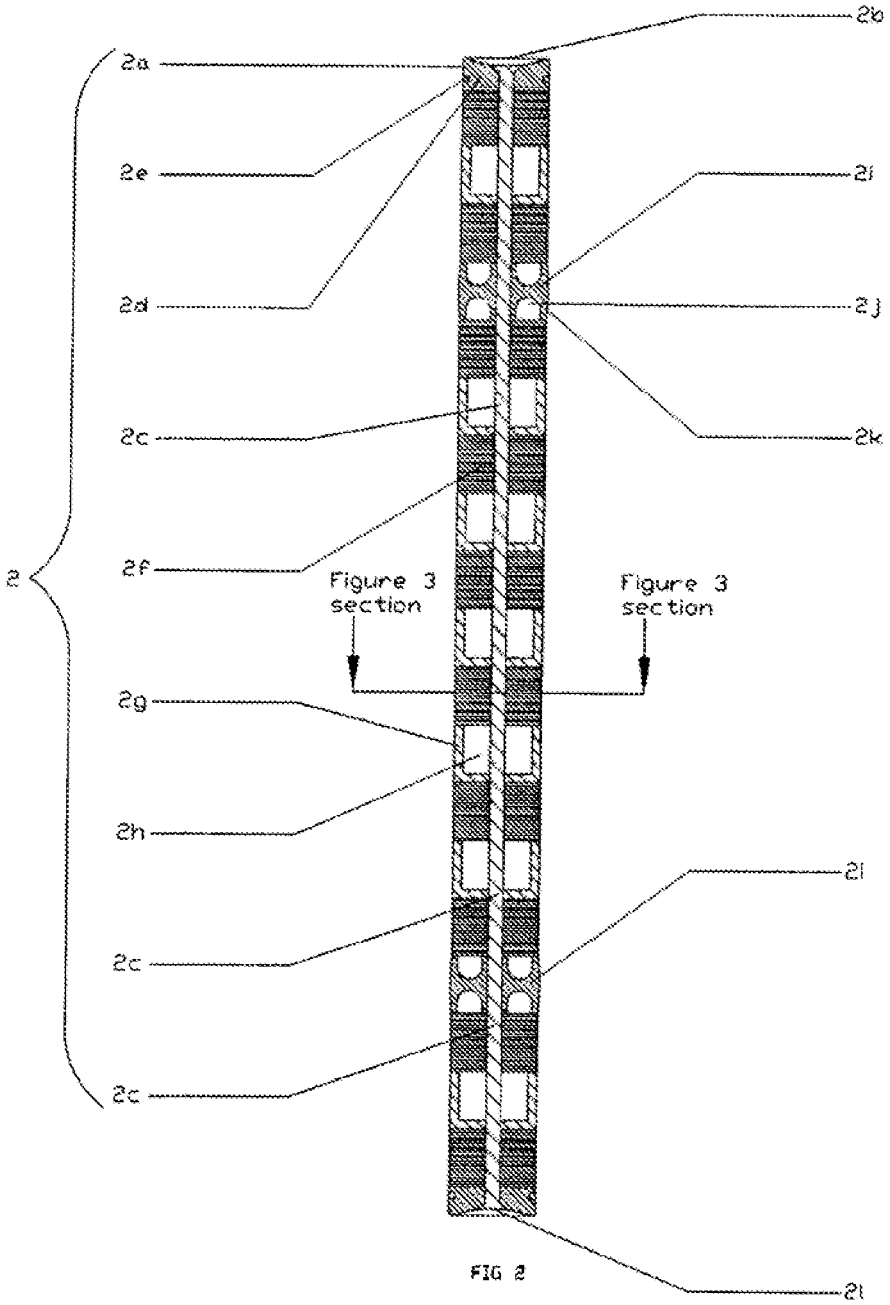
FIG. 2 is a longitudinal section through the piston, showing the construction from planar elements.

FIG. 2 shows a piston 2 having an outer surface 2*a* and comprising a central shaft 2*c* onto which are mounted a series of cylindrical elements. These cylindrical elements may include a piston crown 2*d* at each end of the central shaft 2*c*, each piston crown 2*d* preferably constructed from a temperature resistant and insulating material such as ceramic. The piston crown end surface 2*b* is, preferably, slightly concave, reducing the surface area-to-volume ratios of the first and second chambers 3, 4 at top dead centre and thereby reducing heat losses. Of course, if the cylinder was of a different geometry then the configuration of these elements would be adapted accordingly.

The piston crown 2*d* may include oil control features 2*e* to control the degree of lubrication wetting of the cylinder 1 during operation of the engine. These oil control features may comprise a groove and an oil control ring as are commonly employed in conventional internal combustion engines.

Laminated core elements 2*f* are also mounted on the piston shaft 2*c*. Each core element 2*f* is constructed from laminations of a magnetically permeable material, such as iron ferrite, to reduce eddy current losses during operation of the engine.

Spacer elements 2*g* are also mounted on the piston shaft 2*c*. Each spacer element 2*g* ideally has low magnetic permeability and is preferably constructed from a lightweight material such as aluminium alloy and has a void 2*h* formed within it to further reduce its weight and hence reduce mechanical forces exerted on the engine utilising it. The spacer elements 2*g* are included to fix the relative position of each of the core elements 2*f* and also act to limit the loss of "blow-by" gases flowing out of each chamber 3, 4 through the gap between the piston wall and cylinder wall, whilst keeping the overall mass of the piston 2 assembly to a minimum.

Bearing elements 2*i* are also mounted on the piston shaft 2*c*, located at approximately 25% and 75% of the length of the piston 2 to reduce the risk of thermally-induced distortion of the axis of the piston 2 causing it to lock in the cylinder 1 or otherwise damage the cylinder 1. Each bearing element 2*i* features a weight-reduction void 2*j* and has a diameter very slightly larger than the core elements 2*f* and the spacer elements 2*g*. The bearing elements 2*i* also have a profiled outer surface 2*k* for bearing the weight of the piston 2, and any other side loads present, whilst keeping frictional losses and wear to a minimum. The bearing element 2*i* are preferably constructed from a hard, wear resistant material such as ceramic or carbon and the profiled outer surface 2*k* may be coated in a low friction material.

The bearing element 2*i* may also include oil control features to control the degree of lubrication wetting of the cylinder 1 during operation of the engine. These features may comprise a groove and an oil control ring as are commonly employed in conventional internal combustion engines.

The total length of the piston is, preferably, at least five times its diameter and in any case it is at least sufficiently long to completely close the sliding port valve such that at no time does the sliding port valve allow combustion chambers 3 and 4 to communicate.

Figure 3:
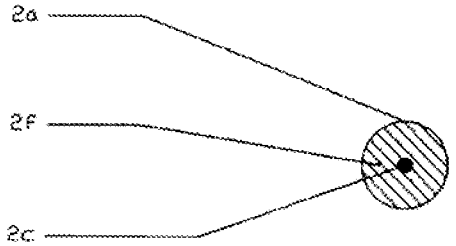
FIG. 3 is a perpendicular section through the piston, showing the concentric arrangement of the shaft and planar elements.

FIG. 3 is a sectional view of the piston 2, showing the piston shaft 2*c* passing through a core element 2*f*. The piston shaft ends 21 are mechanically deformed or otherwise fixed to the piston crowns 2*d* such that the elements 2*f*, 2*g*, 2*i* that are mounted to the piston shaft 2*c* are securely retained under the action of tension maintained in the piston shaft 2*c*.

The alternating arrangement of core elements 2*f* and spacers 2*g* positions the core laminations 2*f* at the correct pitch for efficient operation as, for example, part of a linear switched reluctance generator machine comprising the moving piston 2 and a linear generator means, for example a plurality of coils spaced along the length of the cylinder within which the piston reciprocates.

Figure 4:
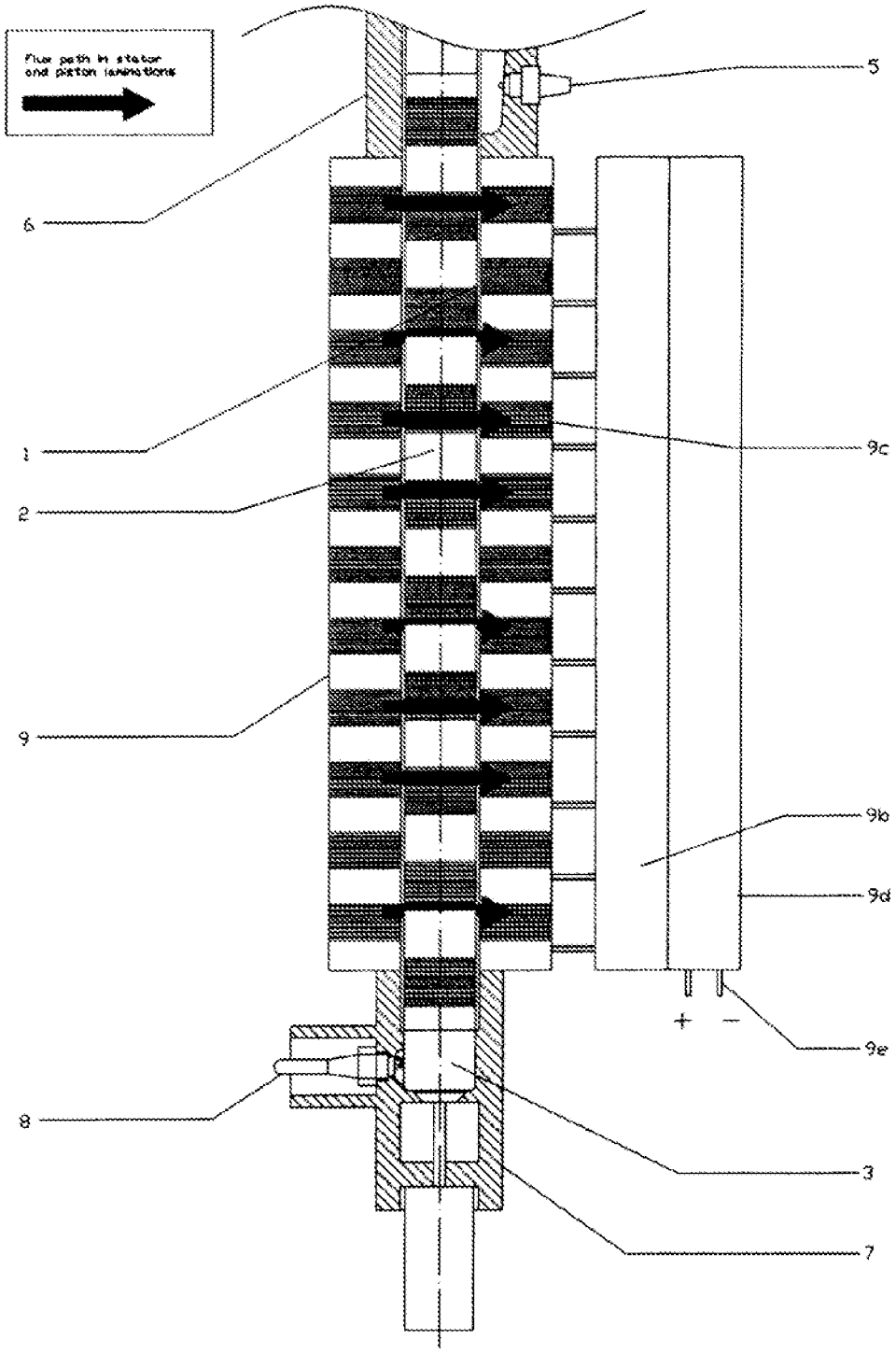
FIG. 4 is a sectional view of the cylinder of FIG. 3 illustrating the magnetic flux in switched stator elements caused by movement of the piston according to the present invention.

FIG. 4 shows an example of linear generator means 9 provided around the outside of the cylinder 1, along at least a portion of its length, for facilitating the transfer of energy between the piston 2 and electrical output means 9*e*. The linear generator means 9 includes a number of coils 9*a* and a number of stators 9*c*, alternating along the length of the linear generator means 9.

The linear generator means 9 may be of a number of different electrical machine types, for example a linear switched reluctance generator. In the arrangement shown, coils 9*a* are switched by switching device 9*b* so as to induce magnetic fields within stators 9*c* and the piston core laminations 2*e*.

The transverse magnetic flux created in the stators 9*c* and piston core laminations 2*f* under the action of the switched coils 9*a* is also indicated in FIG. 4. The linear generator means 9 functions as a linear switched reluctance device, or as a linear switched flux device. Power is generated at the electrical output means 9*e* as the flux circuits, established in the stators 9*c* and induced in the piston core laminations 2*f*, are cut by the motion of the piston 2. This permits a highly efficient electrical generation means without the use of permanent magnets, which may demagnetise under the high temperature conditions within an internal combustion engine, and which might otherwise add significant cost to the engine due the use of costly rare earth metals.

Additionally, a control module 9*d* may be employed, comprising several different control means, as described below. The different control means are provided to achieve the desired rate of transfer of energy between the piston 2 and electrical output means 9*e* in order to deliver a maximum electrical output whilst satisfying the desired motion characteristics of the piston 2, including compression rate and ratio, expansion rate and ratio, and piston dwell time at top dead centre of each chamber 3, 4.

A valve control means may be used to control the intake valve 6*c* and the exhaust valve 7*b*. By controlling the closure of the exhaust valve 7*b*, the valve control means is able to control the start of the compression phase. In a similar way, the valve control means can also be used to control exhaust gas recirculation (EGR), intake charge and compression ratio.

A compression ratio control means that is appropriate to the type of electrical machine may also be employed. For example, in the case of a switched reluctance machine, compression ratio control is partially achieved by varying the phase, frequency and current applied to the switched coils 9*a*. This changes the rate at which induced transverse flux is cut by the motion of the piston 2, and therefore changes the force that is applied to the piston 2. Accordingly, the coils 9*a* may be used to control the kinetic energy of the piston 2, both at the point of exhaust valve 7*b* closure and during the subsequent deceleration of the piston 2.

A spark ignition timing control means may then be employed to respond to any residual cycle-to-cycle variability in the compression ratio to ensure that the adverse impact of this residual variability on engine emissions and efficiency are minimised, as follows. Generally, the expected compression ratio at the end of each compression phase is the target compression ratio plus an error that is related to system variability, such as the combustion event that occurred in the opposite combustion chamber 3, 4, and the control system characteristics. The spark ignition timing control means may adjust the timing of the spark ignition event in response to the measured speed and acceleration of the approaching piston 2 to optimize the combustion event for the expected compression ratio at the end of each compression phase.

The target compression ratio will normally be a constant depending on the fuel 5*a* that is used. However, a compression ratio error may be derived from a +/−20% variation of the combustion chamber height 3*a*. Hence if the target compression ratio is 12:1, the actual compression ratio may be in the range 10:1 to 15:1. Advancement or retardation of the spark ignition event by the spark ignition timing control means will therefore reduce the adverse emissions and efficiency impact of this error.

Additionally, a fuel injection control means may be employed to control the timing of the injection of fuel 5*a* so that it is injected into a combustion chamber 3, 4 immediately prior to the sliding port valve 6*a* closing to reduce HC emissions during scavenging.

Furthermore, a temperature control means may be provided, including one or more temperature sensors positioned in proximity to the coils 9*a*, electronic devices and other elements sensitive to high temperatures, to control the flow of cooling air in the system via the compressor 6*e* in response to detected temperature changes. The temperature control means may be in communication with the valve control means to limit engine power output when sustained elevated temperature readings are detected to avoid engine damage.

Further sensors that may be employed by the control module 9*d* preferably include an exhaust gas (Lambda) sensor and an air flow sensor to determine the amount of fuel 5*a* to be injected into a chamber according to the quantity of air added, for a given fuel type. Accordingly, a fuel sensor may also be employed to determine the type of fuel being used.

FIG. 5*a* shows a perpendicular section through one of the stator elements 9*c*, showing the arrangement of coils 9*a* and stator 9*c* relative to each other. An alternative embodiment is shown in FIG. 5*b*, in which a single stator and coil are used to induce magnetic flux in two adjacent pistons 2. This configuration has a cost advantage compared to that shown in FIG. 5*a* due to the reduced number of coils 9*a* required.

FIG. 6 is a sectional view of the cylinder 1, which is preferably constructed from a material of low magnetic permeability, such as an aluminium alloy. The inner surface 1*c* of the cylinder 1 has a coating 1*e* of a hard, wear-resistant material such as nickel silicon-carbide, reaction bonded silicon nitride, chrome plating, or other metallic, ceramic or other chemical coating. On the outer surface 1*d*, an insulator coating 1*f* such as zirconium oxide or other sufficiently thermally insulating ceramic is applied. It will be apparent to a skilled person that the whole cylinder has an identical construction to this sectional view of the part of the cylinder close to the cylinder end 1*g*.

FIG. 7 shows the intake means 6 provided around the cylinder 1, the intake means 6 comprising apertures 6*a*, which are a corresponding size and align with the apertures 1*a*, 1*b* provided in the cylinder 1, and an air intake 6*b*. The apertures 6*a* in the intake means 6 are connected by a channel 6*h* in which an intake poppet valve 6*c* is seated. The channel 6*h* is of minimal volume, either having a short length, small cross sectional area or a combination of both, to minimise uncontrolled expansion losses within the channel 6*h* during the expansion phase.

The intake poppet valve 6*c* seals the channel 6*h* from an intake manifold 6*f* provided adjacent to the cylinder 1 as part of the air intake 6*b*. The intake poppet valve 6*c* is operated by a poppet valve actuator 6*d*, which may be an electrically operated solenoid means or other suitable electrical or mechanical means.

When the sliding port intake valve 6*a* and the intake poppet valve 6*c* are both open with respect to one of the first or second chambers 3, 4, the intake manifold 6*f* is in fluid communication with that chamber via the channel 6*h*. The intake means 6 is preferably provided with a recess 6*g* arranged to receive the intake poppet valve 6*c* when fully open to ensure that fluid can flow freely through the channel 6*h*.

The air intake 6*b* also includes an intake charge compressor 6*e* which may be operated electrically, mechanically, or under the action of pressure waves originating from the air intake 6*b*. The intake charge compressor 6*e* can also be operated under the action of pressure waves originating from an exhaust means 7 provided at each end of the cylinder 1, as described below. The intake charge compressor 6*e* may be a positive displacement device, centrifugal device, axial flow device, pressure wave device, or any suitable compression device. The intake charge compressor 6*e* elevates pressure in the intake manifold 6*f* such that when the air intake 6*b* is opened, the pressure in the intake manifold 6*f* is greater than the pressure in the chamber 3, 4 connected to the intake manifold 6*f*, thereby permitting a flow of intake charge fluid.

Fuel injection means 5 are also provided within the intake means 6, such as a solenoid injector or piezo-injector 5. Although a centrally positioned single fuel injector 5 may be adequate, there is preferably a fuel injector 5 provided either side of the intake poppet valve 6*c* and arranged proximate to the extremities of the sliding port valves 6*a*. The fuel injectors 5 are preferably recessed in the intake means 6 such that the piston 2 may pass over and past the sliding port intake valves 6*a* and air intake 6*b* without obstruction. The fuel injectors 5 are configured to inject fuel into the respective chambers 3, 4 through each of the sliding port intake valves 6*a*

Lubrication means 10 are also provided preferably recessed within the intake means 6 and arranged such that the piston 2 may pass over and past the intake means 6 without obstruction, whereby the piston may be lubricated.

FIG. 8 shows the exhaust means 7 provided at each end of the cylinder 1. The exhaust means 7 comprises a cylinder head 7*a* removably attached, by screw means or similar, to the end of the cylinder 1. Within each cylinder head 7*a* is located an exhaust poppet valve 7*b*, coaxially aligned with the axis of the cylinder 1. The exhaust poppet valve 7*b* is operated by an exhaust poppet valve actuator 7*c*, which may be an electrically operated solenoid means or other electrical or mechanical means. Accordingly, when the intake poppet valve 6*c* and the exhaust poppet valve 7*b* within the first or second chamber 3, 4, are both closed, that chamber is effectively sealed and a working fluid contained therein may be compressed or allowed to expand.

The exhaust means 7 also includes an exhaust manifold channel 7*d* provided within the cylinder head, into which exhaust gases may flow, under the action of a pressure differential between the adjacent first or second chamber 3, 4 and the fluid within the exhaust manifold channel 7*d* when the exhaust poppet valve 7*b* is open. The flow of the exhaust gases can be better seen in the arrangement of cylinders illustrated in FIG. 20, which shows the direction of the exhaust gas flow to be substantially perpendicular to the axis of the cylinder 1.

Ignition means 8, such as a spark plug, are also provided at each end of the cylinder 1, the ignition means 8 being located within the cylinder head 7*a* and, preferably, recessed such that there is no obstruction of the piston 2 during the normal operating cycle of the engine.

The, preferably, coaxial arrangement of the exhaust poppet valve 7*b* with the axis of the cylinder 1 allows the exhaust poppet valve 7*b* diameter to be much larger relative to the diameter of the chambers 3, 4 than in a conventional internal combustion engine.

Each cylinder head 7*a* is constructed from a hard-wearing and good insulating material, such as ceramic, to minimise heat rejection and avoid the need for separate valve seat components.

FIG. 9 shows a time-displacement plot of an engine according to the present invention, illustrating the movement of the piston 2 over the course of a complete engine cycle. Although the operation of the engine is described here with reference to the first chamber 3, a skilled person will recognise that the operation and sequence of events of the second chamber 4 is exactly the same as the first chamber 3, but 180 degrees out of phase. In other words, the piston 2 reaches top dead centre in the first chamber 3 at the same time as it reaches bottom dead centre in the second chamber 4.

FIG. 9*a* is a table showing a number of different compression ratio control means that may be employed to control the compression ratio in response to changes in signals received from a number of different variables which can affect the compression ratio during an engine cycle. FIG. 9*b* is a flow chart corresponding to FIG. 9*a* and illustrates an exemplary compression ratio control sequence. The compression ratio control means may comprise part of the control module 9*d*, discussed earlier.

Both the table and flow chart illustrate the main variables which can affect the compression ratio at the different stages (A to F) of an engine cycle, such as the one illustrated in FIG. 9. These variables include: power demand from user, the fuel type being used, the compression ratio and knock status from the previous engine cycle, piston position, and the kinetic energy of a piston. The table and flow chart illustrate the different processes that take place to control the compression ratio and how the different variables affect these throughout an engine cycle and also the subsequent effect of each process, which can have an effect on more than one of the control processes throughout the engine cycle. It can be seen that in the last step of the sequence, once the expected compression ratio has been determined, optimum ignition timing is achieved by the spark ignition timing control means adjusting the timing of the spark event.

The events A to F, highlighted throughout the engine cycle, correspond to the events A to F illustrated in FIG. 10, which shows a typical pressure-volume plot for a combustion chamber 3, 4 over the course of the same engine cycle. The events featured in FIGS. 9 to 10 are referred to in the following discussion of FIGS. 11 to 19.

Considering now a complete engine cycle, at the start of the engine cycle, the first chamber 3 contains a compressed mixture composed primarily of pre-mixed fuel and air, with a minority proportion of residual exhaust gases retained from the previous cycle. It is well known that the presence of a controlled quantity of exhaust gases is advantageous for the efficient operation of the engine, since this can reduce or eliminate the need for intake charge throttling as a means of engine power modulation, which is a significant source of losses in conventional spark ignition engines. In addition, formation of nitrous oxide pollutant gases are reduced since peak combustion temperatures and pressures are lower than in an engine without exhaust gas retention. This is a consequence of the exhaust gas fraction not contributing to the combustion reaction, and due to the high heat capacity of carbon dioxide and water in the retained gases.

FIG. 11 shows the position of the piston relative to the cylinder 1, defining the geometry of the first chamber 3 at top dead centre (A). This is also around the point of initiation of the combustion phase AB. The distance between the top of the piston 2*b* and the end of the first chamber 3 is at least half the diameter of the first chamber 3, giving a lower surface area to volume ratio compared to combustion chambers in conventional internal combustion engines, and reducing the heat losses from the first chamber 3 during combustion. The ignition means 8 are recessed within the cylinder head 7*a* so that in the event that the piston 2 approaches top dead centre in an uncontrolled manner there is no possibility of contact between the ignition means 8 and the piston crown 2*d*. Instead, compression will continue until the motion of the piston 2 is arrested by the continuing build up of pressure due to approximately adiabatic compression in the first chamber 3. With reference to FIG. 10, the combustion expansion phase AB is initiated by an ignition event (A).

FIG. 12 shows the position of the piston 2 relative the linear generator means 9 mid-way through the expansion phase (AB and BC). The first chamber 3 expands as the piston 2 moves under the action of the pressure differential between the first chamber 3 and the second chamber 4. The pressure in the second chamber 4 at this point is approximately equivalent to the pressure in the intake manifold 6*f*. The expansion of the first chamber 3 is opposed by the action of the linear generator means 9, which may be modulated in order to achieve a desired expansion rate, to meet the engine performance, efficiency and emissions objectives.

FIG. 13 shows the position of the piston 2 at bottom dead centre relative to the first chamber 3. At the end of the expansion phase (C), the motion of the piston 2 is arrested under the action of the linear generator means 9 and the pressure differential between the first chamber 3 and the second chamber 4. The pressure in the second chamber 4 at this point is approximately equal to the high pressure in the first chamber 3 at its top dead centre position (A). Preferably, the expansion ratio is at least two times the compression ratio, wherein the compression ratio is in the range of 10:1 to 16:1. This gives an improved thermal efficiency compared to conventional internal combustion engines wherein the expansion ratio is similar to the compression ratio.

FIG. 14 shows the arrangement of the piston 2 and intake means 6 and the initial flow of intake gas at the time of bottom dead centre during the intake equalisation phase (CD). This arrangement can also be seen in FIG. 7. At this point, the sliding port intake valve 6*a* is open due to the piston 2 sliding through and past the apertures 1*a*, 1*b* provided along the inner wall 1*c* of the cylinder 1. The pressure in the first chamber 3 is lower than the pressure in the intake manifold 6*f* due to the over-expansion reducing fluid pressure in the first chamber 3 and due to the intake compressor 6*e* elevating the pressure in the intake manifold 6*e*. Around this time, the intake poppet valve 6*c* is opened by intake poppet valve actuator 6*d* allowing intake charge to enter the first chamber 3 within cylinder 1 whose pressure approaches equalisation with the pressure at the intake manifold 6*f*. A short time after the intake poppet valve 6*c* opens, the exhaust poppet valve 7*b* is also opened allowing exhaust gases to exit the first chamber 3 under the action of the pressure differential between the first chamber 3 and the exhaust manifold channel 7*d*, which remains close to ambient atmospheric pressure.

FIG. 15 shows the position of the piston 2 during the intake charge displacement scavenging phase (DE). Exhaust gas scavenging is achieved by the continuing displacement of exhaust gas in the first chamber 3 into the exhaust manifold channel 7*d* with fresh intake charge introduced at the piston end of the first chamber 3. Once the intended quantity of intake charge has been admitted to the first chamber 3, the intake poppet valve 6*c* is closed and the expulsion of exhaust gas continues by the movement of the piston 2, as shown in FIG. 17, explained below.

FIG. 16 shows the arrangement of the piston 2 and intake means 6 at the point of fuel injection (E). Fuel 5*a* is introduced directly onto the approaching piston crown 2*d* which has the effects of rapidly vaporising fuel, cooling the piston crown 2*d* and minimising the losses and emissions of unburned fuel as a wet film on the inner wall 1*c* of the cylinder 1, which might otherwise vaporise in the second chamber 4 during the expansion phase.

FIG. 17 shows the position of the piston 2 during lubrication (E), whereby a small quantity of lubricant is periodically introduced by the lubrication means 10 directly to the piston outer surface 2*a* as it passes the intake sliding port valve 6*a*. This arrangement minimises hydrocarbon emissions associated with lubricant wetting of the cylinder inner wall, and may also reduce the extent of dissolution of fuel in the cylinder inner wall oil film. Oil control ring features 2*e* are included in the piston crown 2*d* and/or bearing elements 2*i* to further reduce the extent of lubricant wall wetting in the first and second chambers 3, 4.

FIG. 18 shows the position of the piston 2 during the piston displacement scavenging phase EF. The intake poppet valve 6*c* is closed and the expulsion of exhaust gas continues by the movement of the piston 2. The piston 2 at this time is moving towards the exhaust means 7 and reducing the volume of the first chamber 3 due to the combustion event in the second chamber 4.

As a result of the relatively larger diameter of the exhaust poppet valve, as discussed above, the limiting area in the exhaust flow past the valve stem may approach 40% of the cylinder bore section area, resulting in low exhaust back pressure losses during both the intake charge displacement scavenging phase (DE) and piston displacement scavenging phase (EF).

FIG. 19 shows a longitudinal section of the position of the piston 2 relative to the cylinder 1 mid-way through the compression phase (FA). When a sufficient exhaust gas expulsion has been achieved, such that the proportion of exhaust gas in the fluid in the first chamber 3 is close to the intended level, the exhaust poppet valve 7*b* is closed and the compression phase (FA) begins. Compression continues at a varying rate as the piston 2 accelerates and decelerates under the action of the pressure differential between the first chamber 3 and the second chamber 4. The pressure in the second chamber 4 is at this point falling during the expansion phases (AB and BC) and by the action of the linear generator means 9. The linear generator force may be modulated in order to achieve the desired compression rate to meet the engine performance, efficiency and emissions objectives. The compression rate in the first chamber 3 is substantially equal to and opposite the expansion rate in chamber 4.

FIG. 20, FIG. 21 and FIG. 22 show the construction of an exemplary engine arrangement comprising four free-piston engines according to the present invention, configured to operate in cycles that are synchronised to create a fully balanced engine. In this configuration, the overall length of the engine generating 50 kw with a thermal efficiency of around 50% is approximately 1400 mm.

FIG. 20, in particular, shows how the cylinder 1 may be located coaxially within a cylinder housing 11, providing structural support and cooling means 12. The cylinder housing 11 may be slightly shorter than the cylinder 1 and the cylinder heads 7*a* may be attached, by screw fixings or any other suitable means, to the cylinder housing 11 to maintain compression between each cylinder head 7*a* and the surface of each cylinder end 1*d*. The cylinder housing 11 is attached, by screw fixings or any other suitable means, to a structural housing 13 which provides the basis for mechanical attachment of the engine to a vehicle or other device drawing electrical power from the electrical output means 9*e*. An enclosure 14 provides a physical enclosure for the engine, manifolds and control systems. Interfaces are provided across the enclosure 14 for intake and exhaust flows, admission of fuel and lubricant, rejection of heat, output of electrical power and input of electrical power for start-up and control.

FIG. 22 shows an end view of an arrangement in which a cylinder head 7*a* houses four engines according to the present invention, whereby exhaust gases exit an engine's combustion chamber 3, 4 via the exhaust poppet valve 7*b* and flow substantially perpendicular to the axes of the cylinders 1.

Advantageously, with the present invention, the narrow bore geometry of the first chamber 3, and the relative positions of the intake means 6 and exhaust means 7, which are located at opposite ends of the first chamber 3, permits a highly efficient and effective scavenging process with little mixing between the intake charge and the exhaust gases. This scheme offers several advantages compared to scavenging in conventional two stroke engines or in free piston two stroke engines.

Firstly, the expulsion of exhaust gases can be accurately controlled by the timing of the exhaust valve closure, providing variable internal exhaust gas recirculation as a means of engine power control without the need for a throttling device and the associated engine pumping losses.

Secondly, the limited mixing between the retained exhaust gas and the intake charge may improve the completeness of combustion since the combustion flame front within the fresh charge is not interrupted by pockets of non-combustible exhaust gas mixed with the combustible fuel/air mixture.

Thirdly, the introduction of fuel 5*a* by the fuel injector means 5 shortly before the closure of the sliding intake port valve 6*a*, and also the introduction of lubricant by the lubrication means 10 around this time, is unlikely to result in fuel or lubricant entrainment in the exhaust gases and cause tailpipe hydrocarbon emissions.

Furthermore, the geometry of the chambers 3, 4 is such that, at top dead centre, the distance between the top of the piston 2*b* and the end of the chambers 3, 4 is at least half the diameter of the chamber 3, 4. The rate of change of compression ratio with piston displacement at top dead centre is therefore smaller than a conventional free piston engine of similar diameter, but in which the depth of the chamber 3, 4 is less. As a result, the impact of small variations in the depth of the first chamber 3 at top dead centre due to combustion variations in the second chamber 4, control system tolerances or other sources of variability, are considerably reduced. Engine operating cycle stability and control are considerably improved by this feature.

By arresting the motion of the piston 2 at top dead centre (A), a desired compression ratio may be achieved. A target compression ratio may be in the range 10:1 to 16:1, and higher compression ratios will in general enable higher thermal efficiencies to be achieved. Different compression ratio targets may be set for different fuels, to take advantage of the octane number characteristics of the particular fuel or blend of fuels in use. Any combination of feedback signals from a knock-sensor, from piston motion, from exhaust gas composition, and from other engine operating characteristics may be used as input to the control module 9*d* in order to achieve the desired compression rate and ratio.

An additional benefit of this embodiment compared to other internal combustion engines is that noise levels are reduced due to the over-expansion cycle and which results in a low pressure differential across the exhaust valve immediately prior to opening. As a result, the shock waves propagating through the exhaust system and causing exhaust noise in a conventional internal combustion engine or free piston engine are substantially avoided.

If the present invention was incorporated into a low cost passenger vehicle having a series hybrid drive train configuration, the cost to the vehicle user as a means for automotive electrical power generation are reduced compared to existing internal combustion engine designs. This reduction in cost is a result of a number of factors, including the low cost of fuel per unit of electrical power generated due to high thermal efficiency. Other factors include the low cost of component manufacture due to the relatively small number of high tolerance dimensions required and hence the low cost of component assembly. Also, the cost of maintenance is low due to the small number of separate components and moving parts required.

Furthermore, the avoidance of complex auxiliary systems and the elimination of complex force transmission pathways including highly stresses hydrodynamic plain bearings characteristic of conventional internal combustion engines and the low cost of materials for the engine, due to the reduced part count and the small number of components having functional design constraints that require the use of high cost materials such as permanent magnets or specialised alloys of aluminium or steel are all factors that help to keep the cost down.

The thermal efficiency is also improved compared to existing internal combustion engine designs. In addition to the factors already discussed, the improved efficiency is also a result of good heat exchange, transferring a proportion of the exhaust, engine and electrical generator heat losses into the intake charge, reduced frictional losses due to the elimination of cylinder wall loads during conversion of cylinder pressure load to crankshaft torque and the elimination of throttling losses due to engine power modulation being achieved by variable intake charge flow duration at full intake boost pressure and variable internal exhaust gas recirculation, and not by throttling intake air flow as is done in a conventional spark ignition engine.

In addition, tailpipe emissions (including NOx, hydrocarbon and particulate emissions) are reduced compared to other known free piston engine designs. This reduction in tailpipe emissions is a result of a number of factors, including: improved control of compression ratio in each cycle due to the elongated electrical generator geometry, which results in a high electrical control authority over piston movement during the compression stroke and therefore a lower piston displacement error at top dead centre; and variable retained exhaust gas composition of compressed charge to reduce peak combustion temperatures and pressures which determine NOx formation.

The invention claimed is:

1. A free-piston engine comprising an engine cylinder and a single piston member comprising a double-ended piston configured to move within the cylinder, wherein (a) the piston member partitions the cylinder into two separate chambers, each of which is supplied with a compressible working fluid from one or more intakes;

(b) the piston being arranged to move over and past the intake during each stroke such that the fluid is replenished within one chamber while the piston compresses the fluid held in the other chamber;

(c) the piston is elongate such that its length is at least five times its diameter; and (d) the cylinder has a length at least ten times its diameter.

2. The engine of claim 1, wherein the intake is located at a central position along the cylinder.

3. The engine of claim 1, wherein the intake comprises an air intake and a fuel injector.

4. The engine of claim 1, wherein the air intake comprises a sliding port valve and a solenoid poppet valve.

5. The engine of claim 4, wherein the fuel injector is configured to inject fuel immediately prior to the closing of the sliding port valve.

6. The engine of claim 1, further comprising means for producing a spark in each of the combustion chambers.

7. The engine of claim 1, further comprising an exhaust provided in each combustion chamber.

8. The engine of claim 1, wherein the engine cylinder has a bore dimensioned such that a compression ratio of about 15:1 and an expansion ratio greater than twice the compression ratio is obtained.

9. A vehicle having an engine according to claim 1.

10. An electrical power generator, comprising the engine of claim 1 and further comprising a plurality of coils positioned along the cylinder of the engine, wherein movement of the piston within the cylinder induces magnetic flux within the coils.

* * * * *